US012421817B2

(12) United States Patent
Jin et al.

(10) Patent No.: US 12,421,817 B2
(45) Date of Patent: Sep. 23, 2025

(54) WELLBORE TRACTOR WITH INDEPENDENT DRIVES

(71) Applicant: Halliburton Energy Services, Inc., Houston, TX (US)

(72) Inventors: Guosheng Jin, Singapore (SG); Nikhil Satyawan Dalvi, Singapore (SG); Winston Alfred Rodrigues, Singapore (SG); Boon Buan Lim, Singapore (SG); Matthew L. Lee, Tomball, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 423 days.

(21) Appl. No.: 17/970,966

(22) Filed: Oct. 21, 2022

(65) Prior Publication Data

US 2023/0349250 A1 Nov. 2, 2023

Related U.S. Application Data

(60) Provisional application No. 63/335,852, filed on Apr. 28, 2022.

(51) Int. Cl.
*E21B 23/04* (2006.01)
*E21B 23/00* (2006.01)

(52) U.S. Cl.
CPC ..... *E21B 23/04* (2013.01); *E21B 23/001* (2020.05)

(58) Field of Classification Search
CPC ..... E21B 23/004
See application file for complete search history.

(56) References Cited

U.S. PATENT DOCUMENTS 6,347,674 B1 * 2/2002 Bloom ..... E21B 33/127 175/98
2015/0300113 A1 10/2015 Guttormsen et al.
2018/0119503 A1 5/2018 McInally
2019/0277102 A1 9/2019 Foucher et al.
2020/0200194 A1 6/2020 McInally

FOREIGN PATENT DOCUMENTS

CN 103174391 A * 6/2013 ..... E21B 23/08
EP 2505772 B1 5/2013

OTHER PUBLICATIONS

CN103174391-A (Year: 2013).*
International Search Report and Written Opinion for the PCT application No. PCT/US2022/047467, issued on Feb. 24, 2023, 11 pages.

* cited by examiner

*Primary Examiner* — Cathleen R Hutchins
(74) *Attorney, Agent, or Firm* — Polsinelli PC

(57) ABSTRACT

A wellbore tractor is provided. The wellbore tractor includes a single hydraulic line and at least one valve disposed along the single hydraulic line. At least two pairs of drives hydraulically coupled with the single hydraulic line such that the single hydraulic line can control the drives to open and/or close. A valve can be disposed along the single hydraulic line between each pair of drives. By controlling the opening and/or closing of each valve, along with controlling the inflow or removal of fluid in the hydraulic line, each pair of drives can be individually controlled to maneuver the wellbore tractor.

17 Claims, 12 Drawing Sheets

WELLBORE TRACTOR WITH INDEPENDENT DRIVES

CROSS REFERENCE TO RELATED APPLICATIONS

This application claims the benefit of U.S. Provisional Application No. 63/335,940, filed on Apr. 28, 2022.

FIELD

The present disclosure relates generally to wellbore tractors with independently retracting and extending drives. In at least one example, the present disclosure relates to wellbore tractors with a single hydraulic line having independently retracting and extending drives.

BACKGROUND

In highly deviated wellbores, tractors may be required to convey the long and heavy tool strings to the designated location for specific operations. Such tractor typically is installed with multiple pairs of drives, which are hydraulically opened to maintain contact against the interior walls of a casing. The drives can be electrically motorized to provide tractoring power required to move the convey tool string forward within the wellbore. Sometimes, the casing will have a includes a size-narrowing section.

BRIEF DESCRIPTION OF THE DRAWINGS

Implementations of the present technology will now be described, by way of example only, with reference to the attached figures, wherein.

DETAILED DESCRIPTION

Figure 1A:
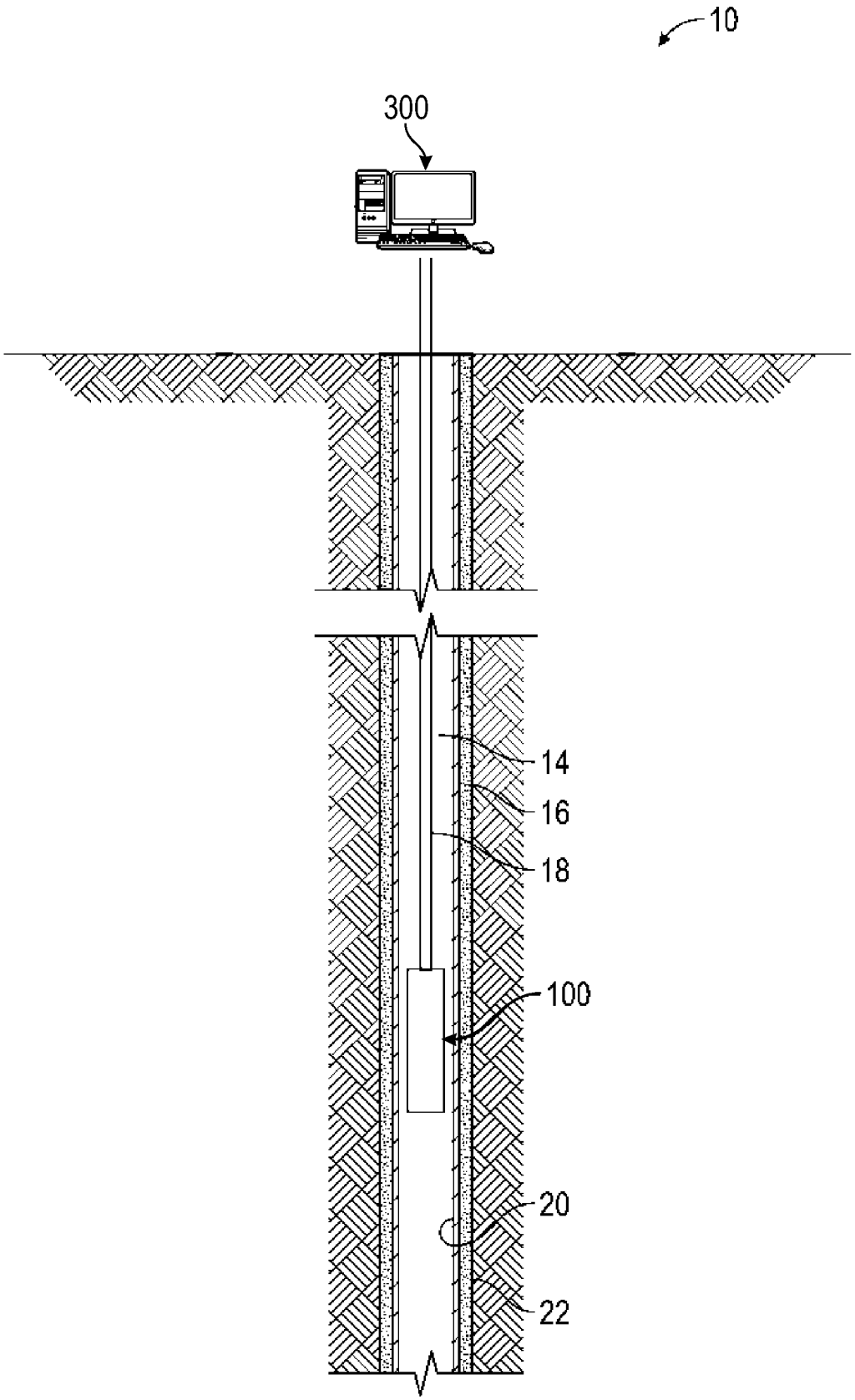
FIG. 1A is a diagram illustrating an exemplary environment for a wellbore tractor according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed herein is a wellbore tractor system operable to hydraulically open and/or close (e.g., extend and/or retract from the body) drives over a single hydraulic line. Each pair of drives and/or each drive can be independently opened and/or closed to navigate different sections and/or obstacles of a wellbore. In conveyance operations, there can be times the casing has a size narrowing-down section. Navigating through such a section can require the wellbore tractor to close selected drives and/or pairs of drives which are passing through such sections while keeping other drives and/or pairs of drives pressurized and motorized, so as to navigate through the sections with success. However, conventionally, closing selected drives and/or pairs of drive with a single shared hydraulic line can cause other drives to close in addition to the selected drive and/or pair of drives, and the tractor will not be able to navigate forward.

The present disclosure describes a sophisticated Independent Drive Control (IDC) method for a wellbore tractor to close selected drives on a single shared hydraulic line without affecting other drives so that the wellbore tractor can remain operational and continue moving through the wellbore and/or pipe. The method can utilize electrically-controlled solenoid valves as isolation devices to create varied pressure zones within a single hydraulic line. By selectively and electrically opening/closing solenoid valves, drives contained within specific pressure zones may be opened/closed with sophisticated control sequence, and hence be controlled as desired when the drives navigate through the narrowing-down section one after another. In at least one example, the solenoid valves can be enclosed as an add-on mechanical section.

The present disclosure provides the ability to open and/or close individual drives or pair of drives without requiring individual hydraulic lines (e.g., for each drive or pair of drives). If included, hydraulic lines (e.g., for drive or pair of drives) would need to run through the entire tool. By having only a single hydraulic line, the wellbore tractor significantly reduces design cost and avoids increase in size and manufacturing cost of the wellbore tractor.

In some examples, the present disclosure provides the ability to add various components (solenoid valve section, microcontroller, etc.) for selected conveyance jobs, which can optimize the cost of tractoring services. In other words, the technology disclosed herein may not be required for normal conveyance jobs (e.g., uniform well casings).

Figure 1B:
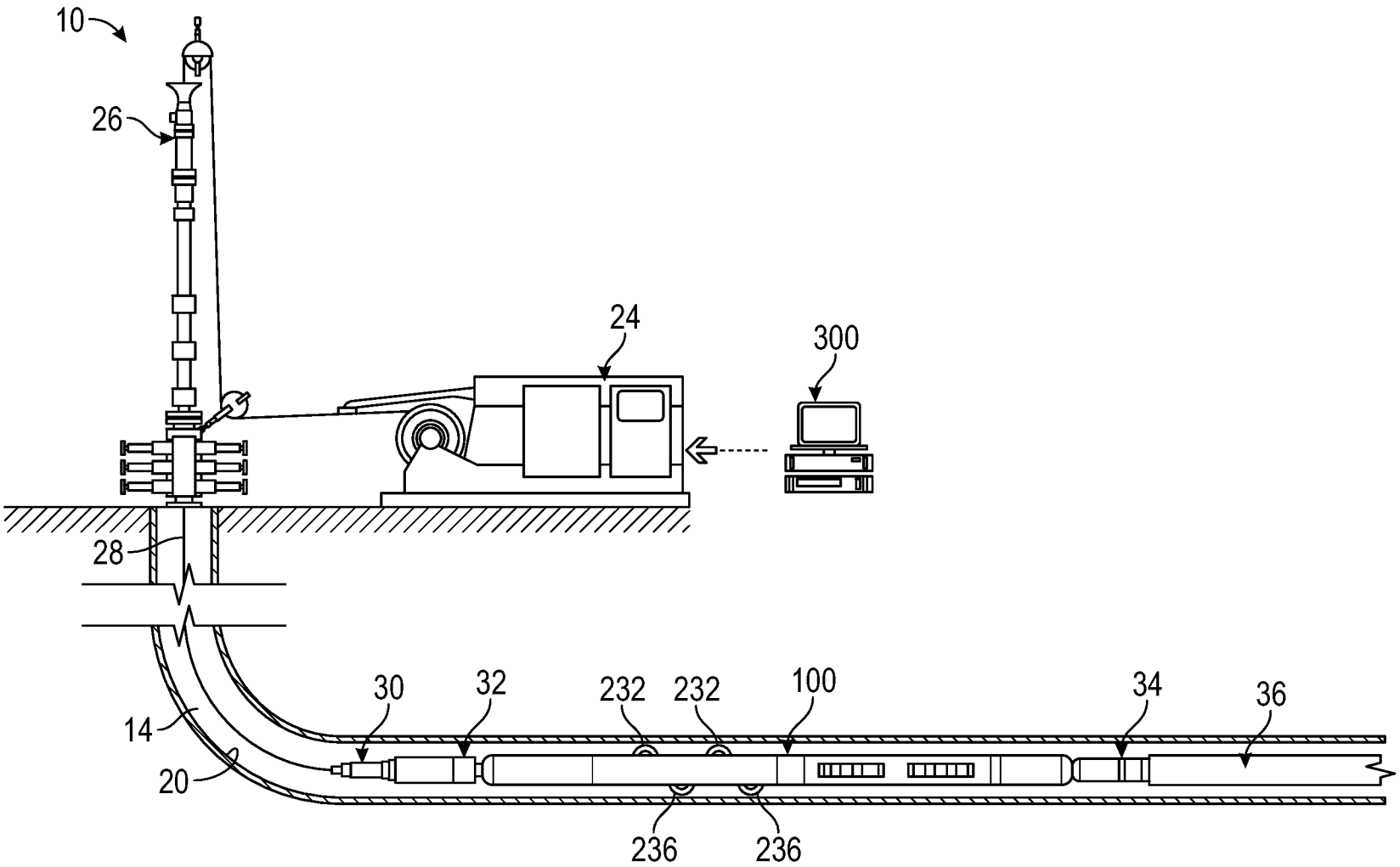
FIG. 1B is a diagram illustrating another exemplary environment for the wellbore tractor.

The wellbore tractor 100 can be employed in an exemplary wellbore system 10 shown, for example, in FIGS. 1A and 1B. The system 10 includes a wellbore tractor 100 traversing a wellbore 14.

As illustrated, for example, in FIG. 1A, the wellbore 14 is within an earth formation 22 and has a casing 20 lining the wellbore 14, the casing 20 can be held into place by cement 16. The wellbore tractor 100 can be disposed within the wellbore 14 and moved up and/or down the wellbore 14. In some examples, the wellbore tractor 100 can be coupled with a conduit 18. In some examples, the wellbore tractor 100 can be pulling the conduit 18 through the wellbore 14. The wellbore tractor 100 can include, for example, downhole sensors, chokes, and/or valves.

Figure 3:
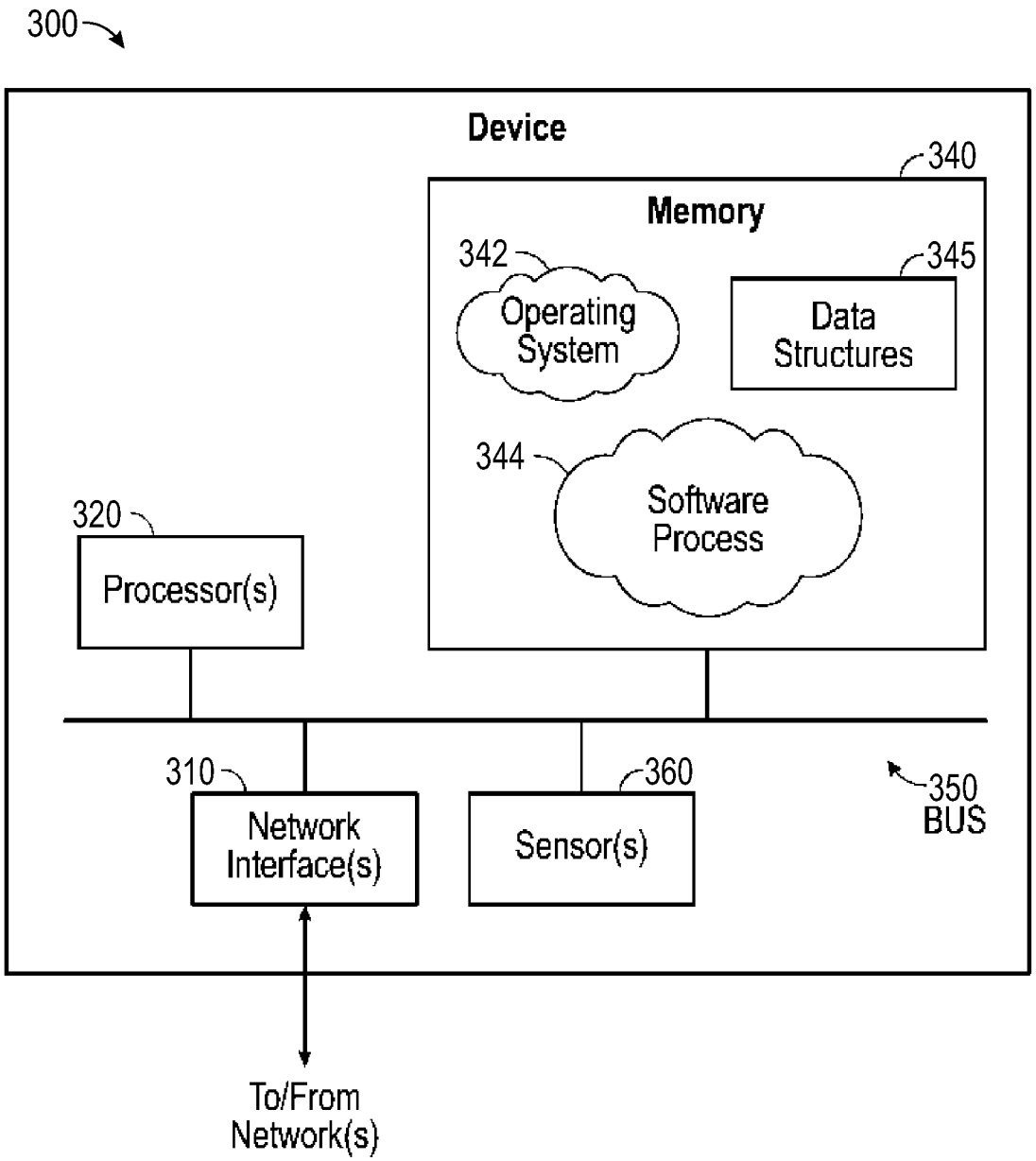
FIG. 3 is a schematic diagram of a controller, which may be employed as shown in FIGS. 1A-2B.

The conduit 18 can be, for example, tubing-conveyed, wireline, slickline, work string, joint tubing, jointed pipe, pipeline, coiled tubing, and/or any other suitable means for conveying downhole tools using a wellbore tractor 100 into a wellbore 14. In some examples, the conduit 18 can include electrical and/or fiber optic cabling for carrying out communications. The conduit 18 can be sufficiently strong and flexible to tether to the wellbore tractor 100 through the wellbore 14, while also permitting communication through the conduit 18 to one or more of the processors 320 (as illustrated in FIG. 3), which can include local and/or remote processors 320. In some examples, power can be supplied via the conduit 18 to meet power requirements of the wellbore tractor 100. For slickline or coiled tubing configurations, power for the wellbore tractor 100 can be supplied downhole with a battery and/or via a downhole generator.

As illustrated, for example, in FIG. 1B, an electric line unit/winch 24 can be used to deliver the wellbore tractor 100. Additionally, the wellbore tractor 100 can be used with electric line pressure control equipment 26. The wellbore tractor 100 can be connected to a logging cable 28 and/or logging head with a swivel 32. The wellbore tractor 100 can be connected to an emergency release 34 and/or a payload 36. The wellbore tractor 100 can include one or more drives 132*a*, 132*b*, 132*c*, 132*d* as discussed in more detail below.

It should be noted that while FIGS. 1A and 1B generally depict land-based operations, those skilled in the art would readily recognize that the principles described herein are equally applicable to operations that employ floating or sea-based platforms and rigs, without departing from the scope of the disclosure. Also, even though FIG. 1A depicts vertical wellbores, the present disclosure is equally well-suited for use in wellbores having other orientations, including horizontal wellbores (as shown in FIG. 1B), slanted wellbores, multilateral wellbores or the like. Further, in some examples the wellbore system 10 can have a casing 20 already implemented while, in other examples, the system 10 can also be used in open hole applications (e.g., no casing).

Additionally, while the disclosure focuses on sections of the wellbore 14 with a restriction 40 (e.g., a narrowed diameter), such as a restriction in a pipe 38, the wellbore tractor 100 and corresponding method can be used for a variety of applications, such as a large opening and/or a gap in the wellbore 14, a fork or multilateral wellbore 14, a bubble in the wellbore 14, and/or to collapse only one drive and/or pair of drives that may not be functioning as desired.

Figure 2A:
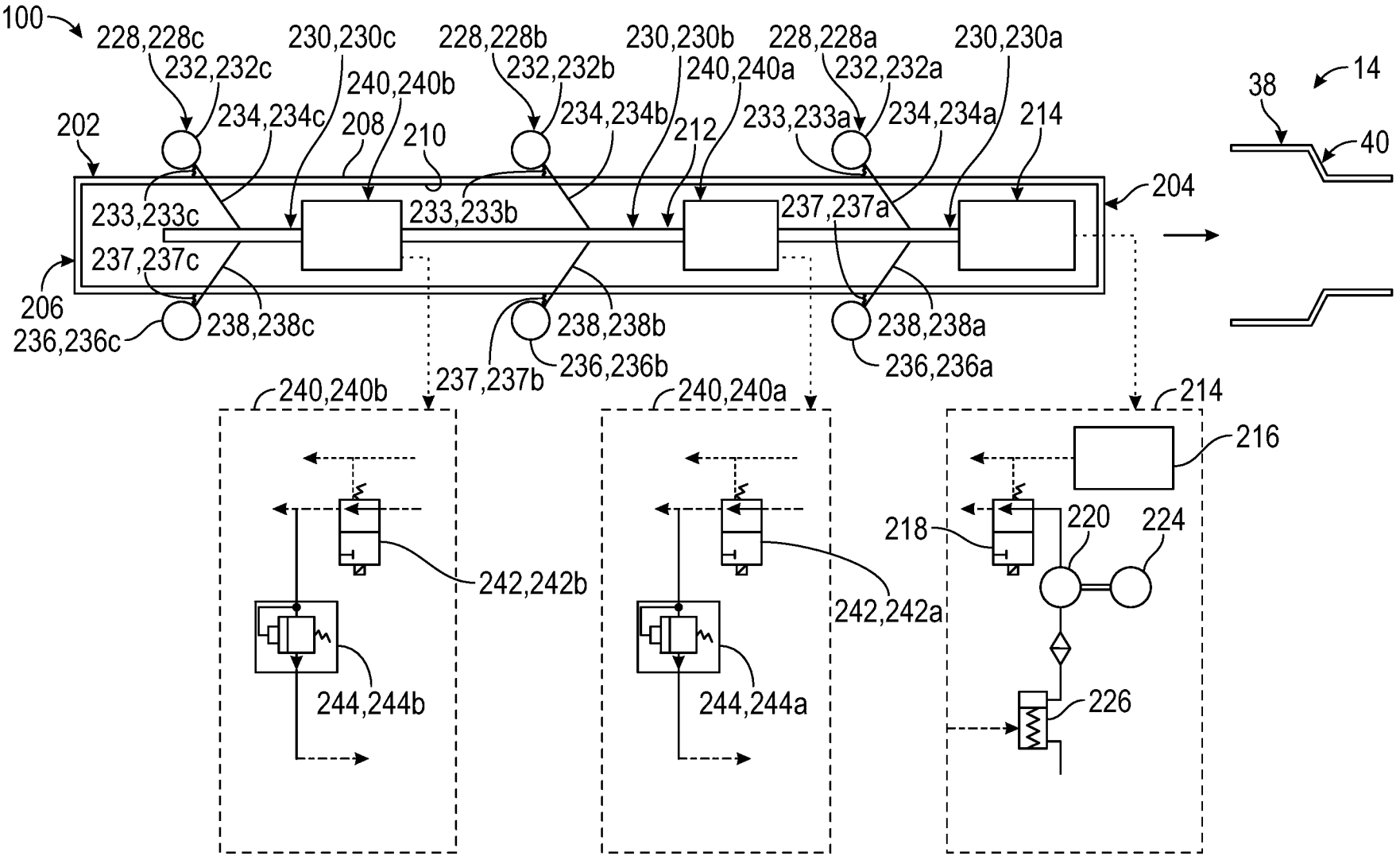
FIG. 2A is a diagram illustrating an exemplary wellbore tractor with six drives.
Figure 2B:
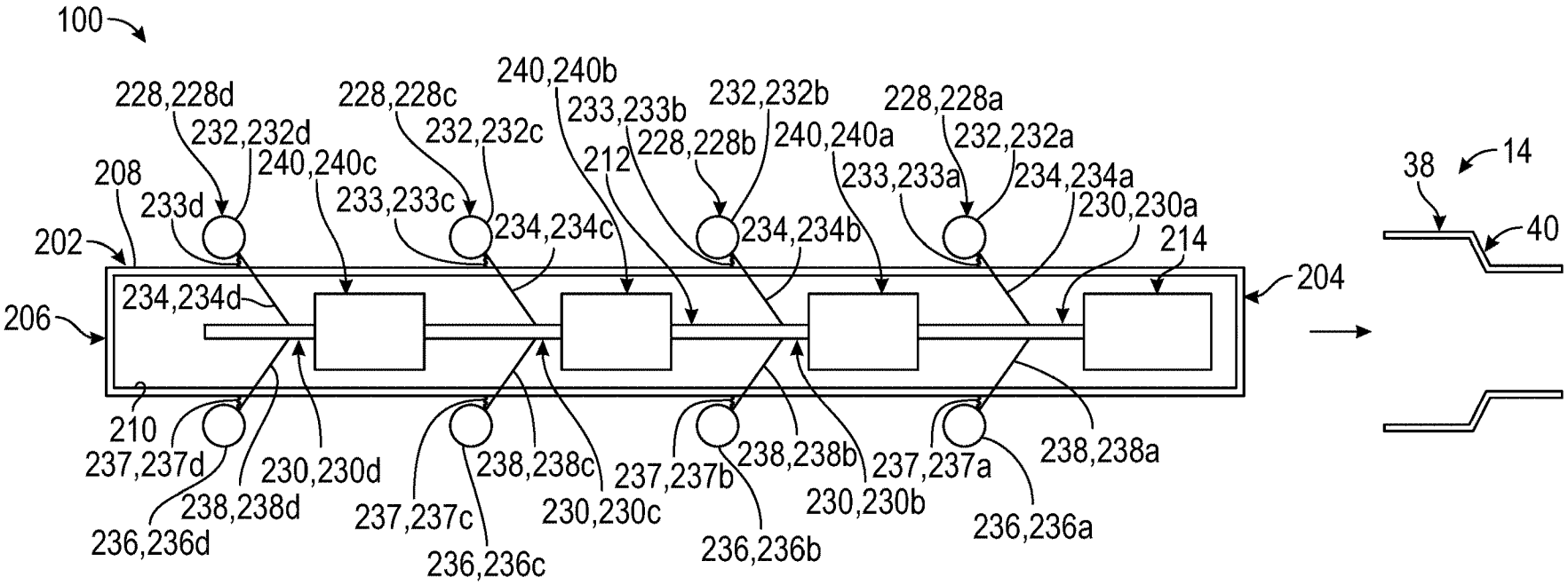
FIG. 2B is a diagram illustrating an exemplary wellbore tractor with eight drives.

FIGS. 2A-2B each illustrate an example of a wellbore tractor 100. The wellbore tractor 100, for example as illustrated in FIG. 2A, includes six drives 232, 236 (e.g., 232*a*, 236*a*, 232*b*, 236*b*, 232*c*, 236*c*), which can be oriented as three pairs of drives 228 (e.g., 228*a*, 228*b*, 228*c*), as discussed below. In some examples, the wellbore tractor 100, for example as illustrated in FIG. 2B, can include eight drives 232, 236 (e.g., 232*a*, 236*a*, 232*b*, 236*b*, 232*c*, 236*c*, 232*d*, 236*d*), which can be oriented as four pairs of drives 228 (e.g., 228*a*, 228*b*, 228*c*, 228*d*), as discussed below.

While the disclosure discusses a six-drive 232, 236 wellbore tractor 100 as illustrated in FIG. 2A, the mechanism and process can apply with four-drive, eight-drive (as illustrated in FIG. 2B), or more than eight-drive wellbore tractors 100. In some examples, the wellbore tractor 100 can include two drives 232*a*, 236*a* or more than eight drives 232, 236 (e.g., ten drives, twelve drives, etc. drives). Additionally, while the disclosure discusses controlling pairs of drives 228, in some examples, additional valves (not shown in the figures) can be incorporated to correspond with each individual drive 232, 236. Accordingly, in some examples, each drive 232, 236 can be controlled individually, which can be utilized to directionally control the wellbore tractor 100.

The pairs of drives 228 (e.g., 228*a*, 228*b*, 228*c*, 228*d*) can be individually extended to an extended configuration and/or retracted to a retracted configuration, which can allow the wellbore tractor 100 to navigate wellbores 14 with restrictions 40 (e.g., size-narrowing sections, openings and/or gaps, forks and/or multilateral paths, and/or bubbles). Each pair of drives 228 can include a first drive 232 (e.g., 232*a*, 232*b*, 232*c*, 232*d*) and a second drive 236 (e.g., 236*a*, 236*b*, 236*c*, 236*d*). The drives 232, 236 can be coupled with one or more motors to cause the drives 232, 236 to move and/or rotate to cause the wellbore tractor 100 to move along the wellbore 14.

One or more independent drive controls 240 (e.g., 240*a*, 240*b*), which can each include at least one valve 242 (e.g., 242*a*, 242*b*), can be disposed along the hydraulic line 212 to separate the drives 232, 236 or pairs of drives 228. Accordingly, the valves 242 create sections 230 (e.g., 230*a*, 230*b*, 230*c*) of the hydraulic line 212 corresponding to the drive 232, 236 or pairs of drives 228 such that each of the drives 232, 236 or pairs of drives 228 can be controlled independently. The valves 242 can be operable to hold pressure in both directions (e.g., open or closed). In either direction, the valves 242 can be rated to hold full pressure (e.g., 7,000 psi). In some examples the valves 242 can be similar valves (e.g., solenoid valves) as in other portions of the wellbore tractor 100. Accordingly, the same controller 216 can be utilized for the entirety of the wellbore tractor 100.

A hydraulic control unit 214 is operable to pump fluids (e.g., hydraulic fluid) to and/or from the single hydraulic line 212. For example, the hydraulic control unit 214 can add to and/or remove hydraulic fluid from the hydraulic line 212 to build and deliver pressures to and/or remove pressure from the connected drives 232, 236 and thus opening and/or closing the respective wheels of the drives 232, 236. When pressure in a section of the hydraulic line 212 is less than a threshold amount, the corresponding drives 232, 236 retract into and/or towards the body 202 of the wellbore tractor 100 to the retracted configuration. In some examples, one or more springs 233, 237 (e.g., 233*a*, 237*a*, 233*b*, 237*b*, 233*c*, 237*c*, 233*d*, 237*d*) can enact a force on a corresponding each of the drives 232, 236 which urge the drives 232, 236 in towards the body 202 of the wellbore tractor 100. When the pressure in the corresponding section 230 (e.g., 230*a*, 230*b*, 230*c*, 230*d*) of the hydraulic line 212 is greater than the threshold amount, the hydraulic pressure can overcome the force from the spring 233, 237 and can open the drives 232, 236 to extend away from the body 202 of the wellbore tractor 100 to the extended configuration. When the pressure in the corresponding section 230 of the hydraulic line 212 is below the threshold amount, the force of the spring 233, 237 can overcome the hydraulic pressure and close the drives 232, 236 to the retracted configuration.

As illustrated in FIGS. 2A-2B, the wellbore tractor 100 includes a body 202, which has a first end 204, a second end 206 opposite the first end 204, and defines a longitudinal axis extending from the first end 204 to the second end 206. The body 202 can define an outer surface 208. Similarly, the body 202 can define an inner surface 210. The distance between the outer surface 208 and the inner surface 210 can define a thickness of the body 202. In some examples, the outer surface 208 and/or inner surface 210 can be generally cylindrical in shape.

Continuing with FIGS. 2A-2B, a hydraulic line 212 can be disposed within the body 202 of the wellbore tractor 100. For example, the hydraulic line 212 can be located, in whole or in part, inside the inner surface 210 of the body 202. In at least one example, the hydraulic line 212 can be entirely disposed within the body 202 (e.g., within the inner surface 210). The hydraulic line 212 can extend from the first end 204 (or near the first end 204) of the body 202 to the second end 206 (or near the second end 206). In some examples, the hydraulic line 212 can generally extend along the longitudinal axis of the body 202 of the wellbore tractor 100. In at least one example, the hydraulic line 212 can enter the body 202 at the first end 204 (e.g., extend through the first end 204 of the wellbore tractor 100). The hydraulic line 212 can terminate within inner surface 210 of the body 202 near the second end 206. The hydraulic line 212 can be operable to convey hydraulic fluid therethrough. In other words, hydraulic fluid can flow within (e.g., through) the hydraulic line 212.

In at least one example, the hydraulic line 212 is a single hydraulic line 212. In other words, multiple hydraulic lines are not used to control the drives 232, 236. Although the hydraulic line 212 can be a single hydraulic line 212, the single hydraulic line 212 can be defined by one or more sections 230 (e.g., 230*a*, 230*b*, 230*c*, 230*d*) of the single hydraulic line 212. For example, as discussed in more detail below, each section 230 can be defined by the hydraulic control unit 214, independent drive controls 240 (e.g., 240*a*, 240*b*, 240*c*), and/or the end of the hydraulic line 212 (e.g., near the second end 206 of the wellbore tractor 100).

Continuing with FIGS. 2A-2B, a hydraulic control unit 214 can be fluidly coupled to the hydraulic line 212. The hydraulic control unit 214 can include a controller 216, a valve 218, a pump 220, a motor 224, and/or a sump 226. In some examples, the hydraulic control unit 214 can be near the first end 204 of the body 202 of the wellbore tractor 100. The hydraulic control unit 214 can be between the first end 204 of the body 202 and a first pair of drives 228*a*. In at least one example, the hydraulic control unit 214 can disposed within the body 202 (e.g., within the inner surface 210) at the first end 204. In at least one example, the hydraulic control unit 214 can be disposed outside of body 202 (e.g., outside the outer surface 208) at the first end 204.

The hydraulic control unit 214 can be operable to add hydraulic fluid to the hydraulic line 212 and/or to remove hydraulic fluid from the hydraulic line 212. For example, a valve 218 can be disposed on the hydraulic line 212 and can be, for example, a solenoid valve (e.g., electrically actuated solenoid valve). The valve 218 can be configured to open and/or close to control the flow of hydraulic fluid through the valve 218. For example, the valve 218 can allow hydraulic fluid flow through when the valve 218 is open and can prevent hydraulic fluid from flowing through when the valve 218 is closed. The valve 218 can be rated to hold full pressure, which can be approximately 7,000 pounds per square inch (psi). In some examples, a pump 220 can be in fluid communication with the hydraulic line 212. The pump 220 can be configured to pump hydraulic fluid into (e.g., add hydraulic fluid to) or out of (e.g., remove hydraulic fluid from) the hydraulic line 212. A motor 224 can be coupled to the pump 220 and configured to operate the pump 220. In at least one example, the pump 220 can be located between the valve 218 and a sump 226.

In some examples, the hydraulic control unit 214 can include a sump 226 (e.g., reservoir), which can be in fluid communication with the hydraulic line 212. The sump 226 can be configured to retain (e.g., store) hydraulic fluid. For example, the pump 220 can pump at least a portion of the hydraulic fluid from the sump 226 to the hydraulic line 212 (e.g., supply hydraulic fluid to the hydraulic line 212). Alternatively, the pump 220 can pump at least a portion of the hydraulic fluid from the hydraulic line 212 to the sump 226 (e.g., remove hydraulic fluid from the hydraulic line 212). The sump 226 can also be in fluid communication with one or more release valves 244 (e.g., 244*a*, 244*b*) and can be configured to receive hydraulic fluid from each release valve 244, as discussed below. In some examples, the hydraulic control unit 214 may not include a sump 226 within the body 202 of the wellbore tractor 100. In some examples, the hydraulic control unit 214 may be coupled to a line and the sump 226 may be disposed in another portion of a wellbore device, at the surface, or any other suitable location.

The hydraulic control unit 214 can include a controller 216. The controller 216 can be in communication with the hydraulic control unit 214 and/or each independent drive control 240 (e.g., 240*a*, 240*b*). The controller 216 can independently (e.g., individually) control the hydraulic control unit 214 (e.g., valve 218, pump 220, and/or motor 224) and each independent drive control 240 (e.g., first valve 242*a*, second valve 242*b*). In this manner, the controller 216 can cause the hydraulic control unit 214 to add to and/or remove hydraulic fluid from one or more sections 230 (e.g., 230*a*, 230*b*, 230*c*) of the hydraulic line 212. The controller 216 can be controlled remotely and/or at the surface, as illustrated in FIGS. 1A-1B.

In at least one example, the controller 216 can be in communication with the valve 218 of the hydraulic control unit 214. In this manner, the controller 216 can be operable to open and/or close the valve 218. For example, the controller 216 can cause the valve 218 to open such that hydraulic fluid can flow through it (e.g., from the hydraulic control unit 214 to the hydraulic line 212, from the hydraulic line 212 to the hydraulic control unit 214). Additionally, the controller 216 can cause the valve 218 to close so that hydraulic fluid cannot flow through it (e.g., retain hydraulic fluid within the first section 230*a* of the hydraulic line 212).

In at least one example, the controller 216 can be communication with each valve 242 (e.g., 242*a*, 242*b*) of each respective independent drive control 240 (e.g., 240*a*, 240*b*). In this manner, the controller 216 can be operable to open and/or close each valve 242 (e.g., 242*a*, 242*b*). For example, the controller 216 can cause the first valve 242*a* to open such that hydraulic fluid can flow through it (e.g., from the first section 230*a* to the second section 230*b* of the hydraulic line 212, from the second section 230*b* to the first section 230*a* of the hydraulic line 212). Additionally, the controller 216 can cause the first valve 242*a* to close so that hydraulic fluid cannot flow through it (e.g., retain hydraulic fluid within the first section 230*a* of the hydraulic line 212, retain hydraulic fluid within the second section 230*b* of the hydraulic line 212). Similarly, the controller 216 can cause the second valve 242*b* in the second independent drive control 240*b* to open such that hydraulic fluid can flow through it (e.g., from the second section 230*b* to the third section 230*c* of the hydraulic line 212, from the third section 230*c* to the second section 230*b* of the hydraulic line 212). Additionally, the controller 216 can cause the second valve 242*b* to close so that hydraulic fluid cannot flow through it (e.g., retain hydraulic fluid within the second section 230*b* of the hydraulic line 212, retain hydraulic fluid within the third section 230*c* of the hydraulic line 212).

In at least one example, the controller 216 can be in communication with the pump 220 and/or motor 224 of the hydraulic control unit 214. In this manner, the controller 216 can be operable to turn the pump 220 and/or motor 224 on and off. For example, the controller 216 can cause the pump 220 to pump hydraulic fluid (e.g., pump hydraulic fluid from the hydraulic control unit 214 to the hydraulic line 212 and/or pump hydraulic fluid from the hydraulic line 212 to the hydraulic control unit 214). Additionally, the controller 216 can cause the pump 220 to turn off (e.g., not pump hydraulic fluid).

As previously discussed, the controller 216 can independently control the valve 218 in the hydraulic control unit 214, the first valve 242*a* in the first independent drive control 240*a*, and the second valve 242*b* in the second independent drive control 240*b*. As a non-limiting example, the controller 216 can cause the first valve 242*a* to open while the second valve 242*b* remains closed. The controller 216 can cause the valve 218 of the hydraulic control unit 214 to open while the first valve 242*a* remains open and the second valve 242*b* remains closed. The controller 216 can cause the pump 220 to pump hydraulic fluid into the hydraulic line 212 (e.g., causing hydraulic fluid to flow through the valve 218 of the hydraulic control unit 214, through the first section 230*a* of the hydraulic line 212, through the first valve 242*a* of the first independent drive control 240*a*, and into the second section 230*b*).

Continuing with FIGS. 2A-2B, one or more pairs of drives 228 (e.g., 228*a*, 228*b*, 228*c*, 228*d*) can be in fluid communication with the hydraulic line 212. Each pair of drives 228 can include a first drive 232 (e.g., 232*a*, 232*b*, 232*c*, 232*d*) and a second drive 236 (e.g., 236*a*, 236*b*, 236*c*, 236*d*). In some examples, each first drive 232 (e.g., 232*a*) can be disposed on the opposite side of the body 202 from each respective second drive 236 (e.g., 236*a*). In at least one example, each first drive 232 can be aligned with each respective second drive 236 in a plane that is perpendicular to the longitudinal axis of the body 202. In other words, each first drive 232 and each respective second drive 236 can be located substantially the same distance from the first end 204 of the body 202 (e.g., substantially the same distance from the hydraulic control unit 214).

Each first drive 232 (e.g., 232*a*, 232*b*, 232*c*, 232*d*) can include an arm 234 (e.g., 234*a*, 234*b*, 234*c*, 234*d*), which can couple the first drive 232 to the body 202. For example, the first end of each arm 234 can be coupled to the body 202 and the second end of each arm 234 can be coupled to the respective first drive 232. The second end of each arm 234 can be operable to move radially with respect to the body 202 (e.g., to move each respective first drive 232 radially with respect to the body 202). Each first drive 232 can include a spring 233 (2.*g*, 233*a*, 233*b*, 233*c*, 233*d*), which can bias the first drive 232 to a retracted configuration with respect to the body 202. In other words, the spring 233 can cause the first drive 232 to transition from an extended configuration to a retracted configuration when hydraulic pressure in the respective section 230 of hydraulic line 212 is less than a lower threshold value.

Similarly, each second drive 236 (e.g., 236*a*, 236*b*, 236*c*, 236*d*) can include an arm 238 (e.g., 238*a*, 238*b*, 238*c*, 238*d*), which can couple the second drive 236 to the body 202. For example, the first end of each arm 238 can be coupled to the body 202 and the second end of each arm 238 can be coupled to the respective second drive 236. The second end of each arm 238 can be operable to move radially with respect to the body 202 (e.g., to move each respective second drive 236 radially with respect to the body 202). Each second drive 236 can include a spring 237 (e.g., 237*a*, 237*b*, 237*c*, 237*d*), which can bias the second drive 236 to a retracted position with respect to the body 202. In other words, the spring 237 can cause the second drive 236 to transition from an extended configuration to a retracted configuration when hydraulic pressure in the respective section 230 of hydraulic line 212 is less than a lower threshold value.

Each pair of drives 228 can be operable to move radially with respect to the body 202 of the wellbore tractor 100. In at least one example, one or more pairs of drives 228 (e.g., 228*a*, 228*b*, 228*c*, 228*d*) can independently transition from a retracted configuration (e.g., positioned radially closer to the body 202) to an extended configuration (e.g., positioned radially farther from the body 202). Similarly, one or more pairs of drives 228 can independently transition from an extended configuration to the retracted configuration. In some examples, the pair of drives 228 radially near the body 202 can be defined as the retracted configuration. In at least one example, each pair of drives 228 can be retracted, in whole or in part, inside the outer surface 208 (e.g., into the body 202). For example, in at least one example, the body 202 can include a recess so that each drive 232, 236 can be retracted, in whole or in part, inside the outer surface 208 of the body 202. In some examples, the pair of drives 228 extended radially outward from the retracted configuration can be defined as the extended configuration. In at least one example, the extended configuration can include the pair of drives 228 extended radially outward to a maximum extended length. The extended configuration can also include the pair of drives 228 extended radially outward to less than the maximum extended length (e.g., the pair of drives 228 makes contact with the inside of the wellbore 14, such as the pipe 38, or any other surface).

In at least one example, each pair of drives 228 can be disposed on the hydraulic line 212 between the hydraulic control unit 214, an independent drive control 240 (e.g., 240*a*, 240*b*, 240*c*, 240*d*), and/or the end of the hydraulic line 212 (e.g., near the second end 206 of the wellbore tractor 100). For example, the first pair of drives 228*a* can be disposed on the hydraulic line 212 between the hydraulic control unit 214 (e.g., valve 218) and the first independent drive control 240*a* (e.g., valve 242*a*). The second pair of drives 228*b* can be disposed on the hydraulic line 212 between the first independent drive control 240*a* (e.g., first valve 242*a*) and the second independent drive control 240*b* (e.g., second valve 242*b*). The third pair of drives 228*c* can be disposed on the hydraulic line 212 between the second independent drive control 240*b* (e.g., second valve 242*b*) and the end of the hydraulic line 212 (e.g., near the second end 206 of the wellbore tractor 100), for example as illustrated in FIG. 2A. In other examples, as illustrated in FIG. 2B, the third pair of drives 228*c* can be disposed on the hydraulic line 212 between the second independent drive control 240*b* (e.g., second valve 242*b*) and the third independent drive control 240*c* (e.g., third valve 242*c*). The fourth pair of drives 228*d* can be disposed on the hydraulic line 212 between the third independent drive control 240*c*

(e.g., third valve 242*c*) and the end of the hydraulic line 212 (e.g., near the second end 206 of the wellbore tractor 100).

In at least one example, each pair of drives 228 can be in fluid communication with a section 230 (as discussed below) of the hydraulic line 212. For example, the first pair of drives 228*a* can be in fluid communication with a first section 230*a* of the hydraulic line 212. The second pair of drives 228*b* can be in fluid communication with a second section 230*b* of the hydraulic line 212. The third pair of drives 228*c* can be in fluid communication with a third section 230*c* of the hydraulic line 212. The fourth pair of drives 228*d* can be in fluid communication with a fourth section 230*d* of the hydraulic line 212.

Each individual pair of drives 228 (e.g., 228*a*, 228*b*, 228*c*, 228*d*) can independently move radially with respect to the body 202 (e.g., move independent of the other drives pair or pairs of drives 228). For example, the first pair of drives 228*a* (e.g., first drive 232*a* and second drive 236*a*) can be in a retracted configuration and, subsequently, can be extended radially outward to an extended configuration. Alternatively, the first pair of drives 228*a* can be in an extended configuration and, subsequently, can be retracted radially inward to a retracted configuration. Independently, the second pair of drives 228*b* (e.g., first drive 232*b* and second drive 236*b*) can be in a retracted configuration and, subsequently, can be extended radially outward to an extended configuration. Alternatively, the second pair of drives 228*b* can be in an extended configuration and, subsequently, can be retracted radially inward to a retracted configuration.

In at least one example, when the first pair of drives 228*a* transitions to the extended configuration, the first drive 232*a* and the second drive 236*a* can abut against the inner wall of the wellbore 14 (e.g., the inner wall of the pipe 38). When the first drive 232*a* and the second drive 236*a* abut against the inner wall of the wellbore 14, the first drive 232*a* and the second drive 236*a* can gain traction against the inner wall of the wellbore 14 so that when the first drive 232*a* and the second drive 236*a* rotate, the wellbore tractor 100 translates along the wellbore 14. In at least one example, the first drive 232*a* and the second drive 236*a* can each exert substantially equal force on the inner wall of the wellbore 14, which can keep the body 202 substantially centralized in the wellbore 14.

In at least one example, when the first pair of drives 228*a* transitions to the retracted configuration, the first drive 232*a* and the second drive 236*a* can separate from the inner wall of the wellbore 14 (e.g., the inner wall for the pipe 38). The retraction may provide clearance between the first pair of drives 228*a* and a restriction 40 (e.g., a narrowed diameter) as the wellbore tractor 100 translates along the wellbore 14.

Each pair of drives 228 (e.g., 228*a*, 228*b*, 228*c*, 228*d*) can independently transition to an extended configuration when the hydraulic pressure at the individual pair of drives 228 (e.g., 228*a*) is greater than a threshold value. For example, the first pair of drives 228*a* can extend when the hydraulic pressure at the first pair of drives 228*a* (e.g., the hydraulic pressure in the first section 230*a* of the hydraulic line 212) is greater than a threshold value. The second pair of drives 228*b* can extend when the hydraulic pressure at the second pair of drives 228*b* (e.g., the hydraulic pressure in the second section 230*b* of the hydraulic line 212) is greater than a threshold value. The third pair of drives 228*c* can extend when the hydraulic pressure at the third pair of drives 228*c* (e.g., the hydraulic pressure in the third section 230*c* of the hydraulic line 212) is greater than a threshold value. The fourth pair of drives 228*d* can extend when the hydraulic pressure at the fourth pair of drives 228*d* (e.g., the hydraulic pressure in the fourth section 230*d* of the hydraulic line 212) is greater than a threshold value.

Each pair of drives can independently transition to a retracted configuration when the hydraulic pressure at the individual pair of drives 228 is less than a threshold value. For example, the first pair of drives 228*a* can retract when the hydraulic pressure at the first pair of drives 228*a* (e.g., the hydraulic pressure in the first section 230*a* of the hydraulic line 212) is less than a threshold value. The second pair of drives 228*b* can retract when the hydraulic pressure at the second pair of drives 228*b* (e.g., the hydraulic pressure in the second section 230*b* of the hydraulic line 212) is less than a threshold value. The third pair of drives 228*c* can retract when the hydraulic pressure at the third pair of drives 228*c* (e.g., the hydraulic pressure in the third section 230*c* of the hydraulic line 212) is less than a threshold value. The fourth pair of drives 228*d* can retract when the hydraulic pressure at the fourth pair of drives 228*d* (e.g., the hydraulic pressure in the fourth section 230*d* of the hydraulic line 212) is less than a threshold value.

Continuing with FIGS. 2A-2B, one or more independent drive controls 240 (e.g., 240*a*, 240*b*) can be disposed on the hydraulic line 212. Each independent drive control 240 can include a valve 242 (e.g., 242*a*, 242*b*) and/or a release valve 244 (e.g., 244*a*, 244*b*).

Each independent drive control 240 can control the flow of hydraulic fluid therethrough. For example, each independent drive control 240 can include a valve 242 (e.g., 242*a*, 242*b*), which can control the flow of hydraulic fluid therethrough. Each valve 242 can be disposed on the hydraulic line 212 and can be, for example, a solenoid valve (e.g., electrically actuated solenoid valve). Each valve 242 can be configured to open and/or close to control the flow of hydraulic fluid through the valve 242. For example, each valve 242 can allow hydraulic fluid flow through the hydraulic line 212 across the valve 242 when the valve 242 is open and can prevent hydraulic fluid from flowing through when the valve 242 is closed. Each valve 242 can be rated to hold full pressure, which can be approximately 7,000 pounds per square inch (psi).

In at least one example, each independent drive control 240 can include a release valve 244 (e.g., 244*a*, 244*b*) that can be in fluid communication with the hydraulic line 212. In some examples, each release valve 244 can be in fluid communication with the respective valve 242 (e.g., 242*a*, 242*b*) of the respective independent drive control 240 (e.g., 240*a*, 240*b*). In some examples, each release valve 244 can be in fluid communication with a section 230 of the hydraulic line 212. In some examples, the release valve 244 can be in fluid communication external from the body 202 of the wellbore tractor 100 (e.g., into the wellbore). Each release valve 244 can control the flow of hydraulic fluid therethrough. Each release valve 244 can relieve hydraulic pressure (e.g., release at least a portion of the hydraulic fluid) within the respective section 230 of the hydraulic line 212, which can cause the respective pair of drives 228 to transition to a retracted configuration. For example, a first release valve 244*a* can be in fluid communication with the second section 230*b* of the hydraulic line 212. Similarly, a second release valve 244*b* can be in fluid communication with the third section 230*c* of the hydraulic line 212. Each release valve 244 can be in fluid communication with the sump 226 such that hydraulic fluid will flow to the sump 226 if the release valve 244 releases hydraulic fluid.

In some examples, each release valve 244 can function as a safety valve, which can relieve hydraulic pressure in an over-pressure condition. For example, the first release valve

244*a* can be configured to relieve hydraulic pressure (e.g., release at least a portion of the hydraulic fluid) from the first section 230*a* of the hydraulic line 212 when the hydraulic pressure exceeds a maximum threshold in the first section 230*a*. In some examples, the controller 216 can be in communication with each release valve 244 and the controller 216 can be operable to open and/or close the release valve 244. For example, the controller 216 can cause the first release valve 244*a* to open and/or close. In this manner, the release valve 244 can relieve hydraulic pressure from a section 230 of the hydraulic line 212 if the hydraulic control unit 214 (e.g., valve 218) and/or one or more independent drive controls 240 (e.g., valve 242) are not functioning properly (e.g., stuck). In other words, the release valve 244 can open to relieve hydraulic pressure from a section 230 of the hydraulic line so that the pair of drives 228 in fluid communication with that section 230 transitions from an extended configuration to a retracted configuration. Accordingly, the pair of drives 288 that is not functioning does not remain in the extended configuration and act as an obstacle when trying to move (e.g., retract) the wellbore tractor 100.

In at least one example, each independent drive control 240 can be positioned between adjacent sets of pairs of drives 228 disposed on the hydraulic line 212. For example, a first independent drive control 240*a* can be disposed on the hydraulic line 212 between the first pair of drives 228*a* and the second pair of drives 228*b*. A second independent drive control 240*b* can be disposed on the hydraulic line 212 between the second pair of drives 228*b* and the third pair of drives 228*c*. A third independent drive control 240*c* can be disposed on the hydraulic line 212 between the third pair of drives 228*c* and the fourth pair of drives 228*d*, as illustrated in FIG. 2B.

In at least one example, each independent drive control 240 can define, in whole or in part, a section 230 (e.g., 230*a*, 230*b*, 230*c*, 230*d*) of the hydraulic line 212. For example, a first section 230*a* of the hydraulic line 212 can be defined between the hydraulic control unit 214 (e.g., valve 218) and the first independent drive control 240*a* (e.g., first valve 242*a*). A second section 230*b* of the hydraulic line 212 can be defined between the first independent drive control 240*a* (e.g., first valve 242*a*) and the second independent drive control 240*b* (e.g., second valve 242*b*). A third section 230*c* of the hydraulic line 212 can be defined between the second independent drive control 240*b* (e.g., second valve 242*b*) and the end of the hydraulic line 212 (e.g., near the second end 206 of the wellbore tractor 100), for example as illustrated in FIG. 2A. In other examples, as illustrated in FIG. 2B, the third section 230*c* of the hydraulic line 212 can be defined between the second independent drive control 240*b* (e.g., second valve 242*b*) and the third independent drive control 240*c* (e.g., third valve 242*c*). A fourth section 230*d* of the hydraulic line 212 can be defined between the third independent drive control 240*c* (e.g., third valve 242*c*) and the end of the hydraulic line 212 (e.g., near the second end 206 of the wellbore tractor 100).

In some examples, a sensor (not shown in the figures) can be fluidly coupled to each section 230 (e.g., 230*a*, 230*b*, 230*c*) of the hydraulic line 212, and each sensor can be in communication with the controller 216. Each sensor can measure hydraulic pressure within the respective section 230 of the hydraulic line 212. The controller 216 can cause the pair of drives 228 (e.g., 228*a*, 228*b*, 228*c*) to transition to the retracted configuration if the hydraulic pressure in the respective section 230 of the hydraulic line 212 exceeds an upper threshold value. For example, a first sensor (not show in the figures) can be coupled to the first section 230*a* of the hydraulic line 212 and can measure hydraulic pressure within the first section 230*a*. The controller 216 can cause the first pair of drives 228*a* to transition to the retracted configuration if the hydraulic pressure is greater than an upper threshold value in the first section 230*a* of the hydraulic line 212. In at least one example, with the sensor(s), the controller 216 can automatically transition the pairs of drives 228 between the extended configuration and the retracted configuration without user input and/or assistance.

FIG. 3 is a block diagram of an exemplary controller 300. The controller 300 can be utilized from the surface and/or remotely, as illustrated in FIGS. 1A-1B. The controller 300, as illustrated in FIG. 3, can also apply to the solenoid and/or valve controller 216 as shown in FIGS. 2A and 2B. Controller 300 is configured to perform processing of data and communicate with the valves (e.g., solenoid valves), for example as illustrated in FIGS. 1A-2B and 4A-5G. In some examples, controller 300 can be configured to perform processing of data and communicate with the drives (e.g., motors, etc.) to cause the drives to rotate and move the wellbore tractor 100. In operation, controller 300 communicates with one or more of the above-discussed components and may also be configured to communication with remote devices/systems.

As shown, controller 300 includes hardware and software components such as network interfaces 310, at least one processor 320, sensors 360 and a memory 340 interconnected by a system bus 350. Network interface(s) 310 can include mechanical, electrical, and signaling circuitry for communicating data over communication links, which may include wired or wireless communication links. Network interfaces 310 are configured to transmit and/or receive data using any variety of different communication protocols.

Processor 320 represents a digital signal processor (e.g., a microprocessor, a microcontroller, or a fixed-logic processor, etc.) configured to execute instructions or logic to perform tasks in a wellbore environment. Processor 320 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 320 typically operates in conjunction with shared or dedicated hardware, including but not limited to, hardware capable of executing software and hardware. For example, processor 320 may include elements or logic adapted to execute software programs and manipulate data structures 345, which may reside in memory 340.

Sensors 360 typically operate in conjunction with processor 320 to perform measurements, and can include special-purpose processors, detectors, transmitters, receivers, and the like. In this fashion, sensors 360 may include hardware/software for generating, transmitting, receiving, detection, and/or logging parameters.

Memory 340 comprises a plurality of storage locations that are addressable by processor 320 for storing software programs and data structures 345 associated with the embodiments described herein. An operating system 342, portions of which may be typically resident in memory 340 and executed by processor 320, functionally organizes the device by, inter alia, invoking operations in support of software processes and/or services 344 executing on controller 300. These software processes and/or services 344 may perform processing of data and communication with controller 300, as described herein. Note that while process/service 344 is shown in centralized memory 340, some examples provide for these processes/services to be operated in a distributed computing network.

Other processor and memory types, including various computer-readable media, may be used to store and execute program instructions pertaining to the wellbore tractor described herein. Also, while the description illustrates various processes, it is expressly contemplated that various processes may be embodied as modules having portions of the process/service 344 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 320 or computer readable medium encoded with instructions for execution by processor 320 that, when executed by the processor, are operable to cause the processor to perform the functions described herein.

Additionally, the controller 300 can apply machine learning, such as a neural network or sequential logistic regression and the like, to determine relationships between the reflected signals from the pressure pulses received by the sensors. For example, a deep neural network may be trained in advance to capture the complex relationship between the reflected acoustic wave and the pipeline internal diameter variation. This neural net can then be deployed in the determination of how to control the valves and the corresponding drives to maneuver the wellbore tractor 100 through the wellbore 14.

Figure 4A:
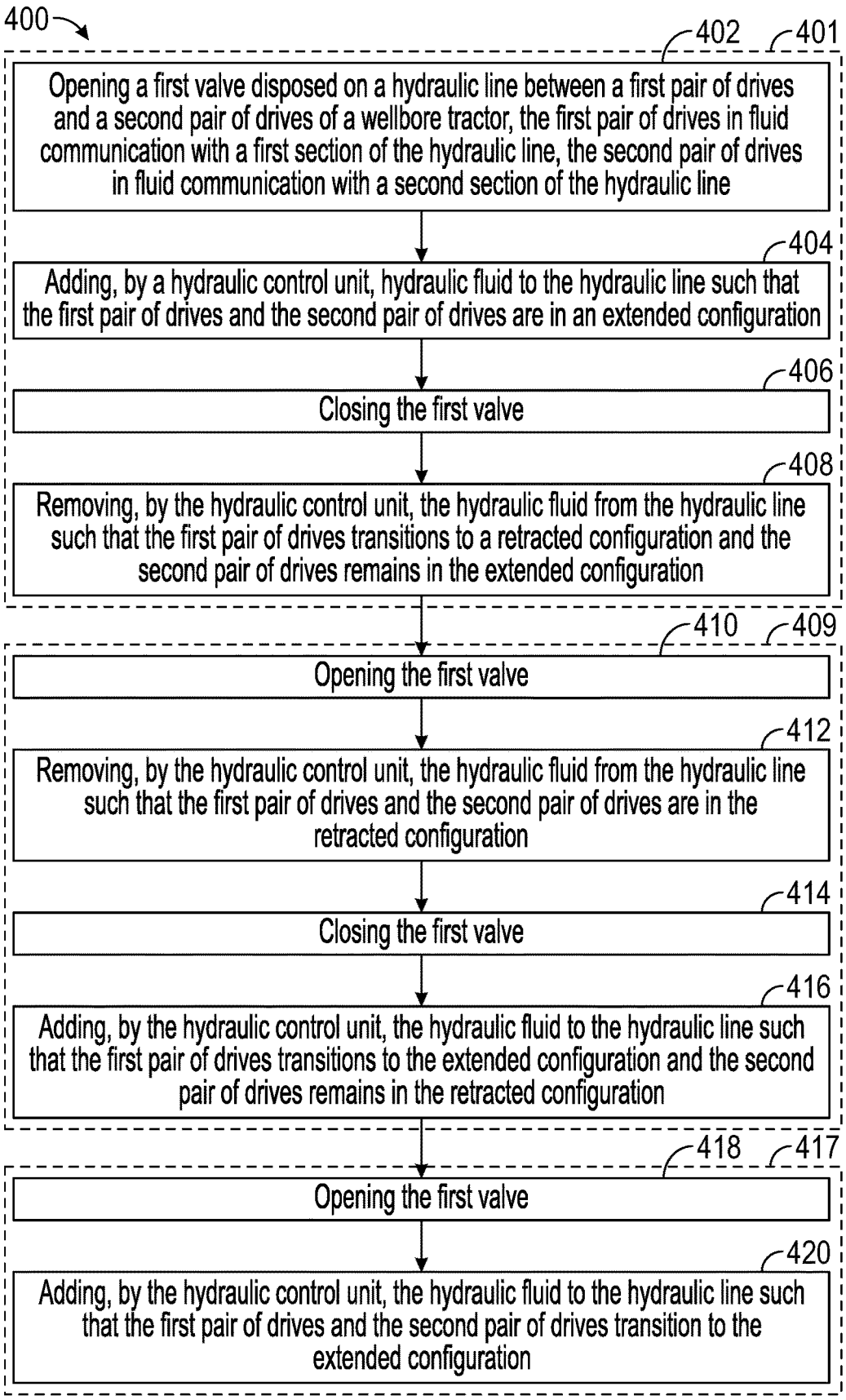
FIG. 4A is a flow chart of a method for controlling the wellbore tractor.
Figure 4B:
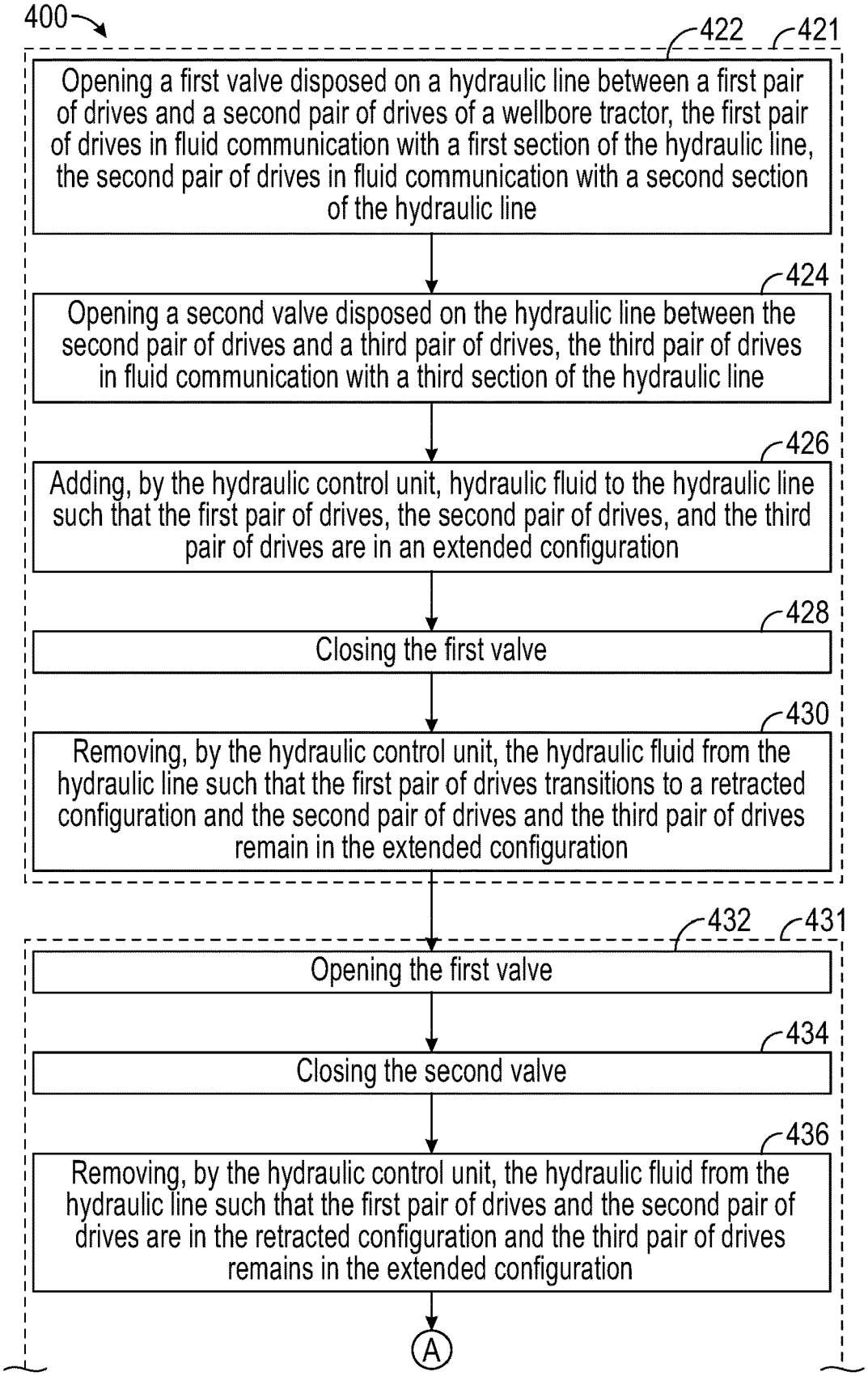
FIGS. 4B and 4C are a flow chart of a method for controlling the wellbore tractor.
Figure 4C:
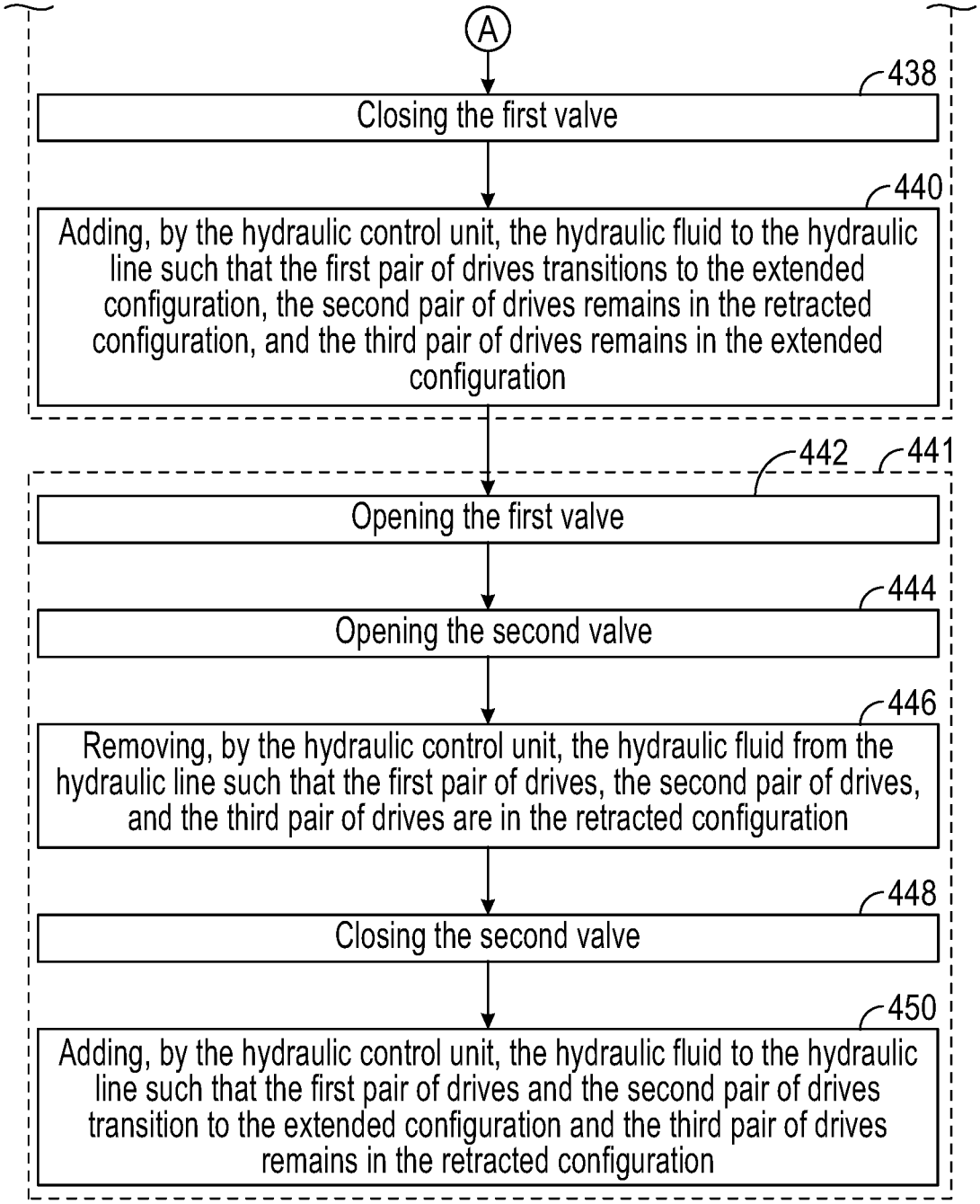

Referring to each of FIG. 4A and FIGS. 4B-4C, a flowchart is presented in accordance with an example embodiment. FIG. 4A discusses controlling only two pairs of drives while FIGS. 4B-4C discusses controlling three pairs of drives. While the flowcharts discuss controlling a wellbore tractor with two and/or three pairs of drives, the same sequencing can apply for any number of drives. The method 400 is provided by way of example, as there are a variety of ways to carry out the method. The method 400 described below can be carried out using the configurations illustrated in FIGS. 1A-3 and 5A-5G, for example, and various elements of these figures are referenced in explaining example method 400. Each block shown in FIGS. 4A-4C represents one or more processes, methods or subroutines, carried out in the example method 400. Furthermore, the illustrated order of blocks is illustrative only and the order of the blocks can change according to the present disclosure. Additional blocks may be added or fewer blocks may be utilized, without departing from this disclosure.

FIG. 4A discusses a method 400 for controlling two pairs of drives, which can include, for example, method 401, method 409, and/or method 417. Method 401 discusses one example of transitioning a first pair of drives to the retracted configuration. Method 409 discusses one example of transitioning the first pair of drives to the extended configuration and transitioning the second pair of drives to the retracted configuration. Method 417 discusses one example of transitioning the second pair of drives to the extended configuration.

Method 401 discusses one example of transitioning a first pair of drives to the retracted configuration. At block 402, a first valve disposed on a hydraulic line between a first pair of drives and a second pair of drives of a wellbore tractor can be opened. The first pair of drives can be in fluid communication with a first section of the hydraulic line and the second pair of drives can be in fluid communication with a second section of the hydraulic line. At block 404, the hydraulic control unit can add hydraulic fluid to the hydraulic line such that the first pair of drives and the second pair of drives are in an extended configuration. At block, 406, the first valve can be closed. At block 408, the hydraulic control unit can remove the hydraulic fluid from the hydraulic line such that the first pair of drives transitions to a retracted configuration and the second pair of drives remains in the extended configuration.

Method 409 discusses one example of transitioning the first pair of drives to the extended configuration and transitioning the second pair of drives to the retracted configuration. At block 410, the first valve can be opened. At block 412, the hydraulic control unit can remove the hydraulic fluid from the hydraulic line such that the first pair of drives and the second pair of drives are in the retracted configuration. At block 414, the first valve can be closed. At block 416, the hydraulic control unit can add hydraulic fluid to the hydraulic line such that the first pair of drives transitions to the extended configuration and the second pair of drives remains in the retracted configuration.

Method 417 discusses one example of transitioning the second pair of drives to the extended configuration. At block 418, the first valve can be opened. At block 420, the hydraulic control unit can add the hydraulic fluid to the hydraulic line such that the first pair of drives and the second pair of drives transition to the extended configuration.

FIGS. 4B and 4C discuss a method 400 for controlling three pairs of drives, which can include, for example, method 421, method 431, and/or method 441. Method 421 discusses one example of transitioning a first pair of drives to the retracted configuration. Method 431 discusses one example of transitioning the first pair of drives to the extended configuration and transitioning the second pair of drives to the retracted configuration. Method 441 discusses one example of transitioning the second pair of drives to the extended configuration and transitioning the third pair of drives to the retracted configuration.

The method in FIGS. 4B and 4C are discussed in conjunction with FIGS. 5A-5G, which are diagrams of an exemplary wellbore tractor 100 maneuvering through a restriction 40 (e.g., a narrowed diameter) of a wellbore 14 (e.g., a pipe 38). In some examples, the wellbore tractor 100 can be moved (e.g., be advanced) through the wellbore 14 during or between the various sequencing that controls the three pairs of drives 228. As a non-limiting example, the first pair of drives 228*a* can transition to a retracted configuration before, during, or after the first pair of drives 228*a* reaches a restriction 40 in the wellbore 14. Then, the wellbore tractor 100 can be advanced with the first pair of drives 228*a* in the retracted configuration.

Although FIGS. 5A-5G discuss a wellbore tractor 100 that has three pairs of drives 228, the same maneuvering operation can apply for any number of drives. The maneuvering operation is provided by way of example, as there are a variety of ways to carry out the maneuvering operation. The maneuvering operation described below can be carried out using the methods illustrated in FIGS. 4A-4C, for example. Additionally, the maneuvering operations can be carried out using configurations illustrated in FIGS. 1A-3 and various elements previously discussed with respect to FIGS. 1A-3.

Figure 5A:
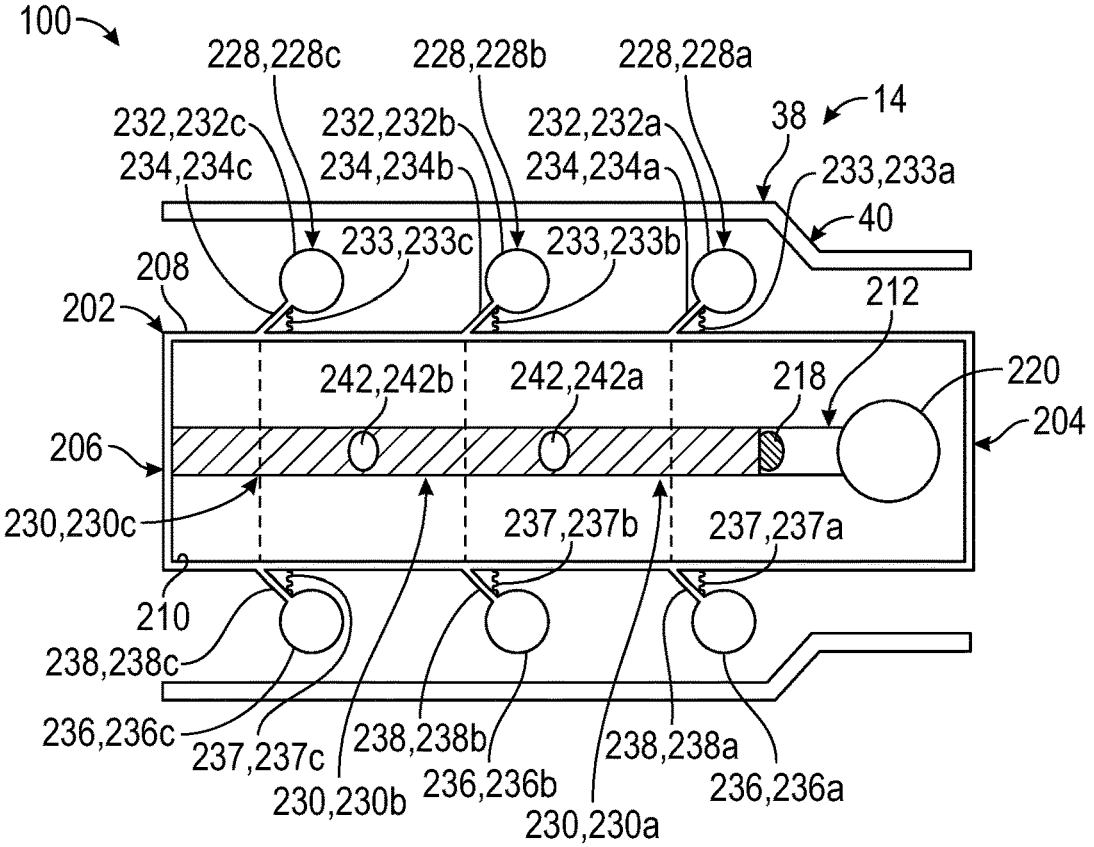
FIGS. 5A-5G are diagrams of an exemplary wellbore tractor maneuvering through a narrowed section of a wellbore.

Method 421 discusses one example of transitioning a first pair of drives 228*a* to the retracted configuration. At block 422, a first valve 242*a* disposed on a hydraulic line 212 between a first pair of drives 228*a* and a second pair of drives 228*b* of a wellbore tractor 100 can be opened (as illustrated by the white ovals without hatching), as illustrated in FIG. 5A. The first pair of drives 228*a* can be in fluid communication with a first section 230*a* of the hydraulic line 212 and the second pair of drives 228*b* can be in fluid communication with a second section 230*b* of the hydraulic line 212. At block 424, a second valve 242*b* disposed on the hydraulic line between the second pair of drives 228*b* and a third pair of drives 228*c* can be opened. The third pair of drives 228*c* can be in fluid communication with a third section 230*c* of the hydraulic line 212.

Continuing with method 421, at block 426, the hydraulic control unit (not shown in FIGS. 5A-5G) can add hydraulic fluid to the hydraulic line 212 (e.g., valve 218 can be opened for hydraulic fluid to flow through the valve 218 (as illustrated by the downward-diagonal hatching) into the hydraulic line 212) such that the first pair of drives 228*a*, the second pair of drives 228*b*, and the third pair of drives 228*c* are in an extended configuration, as illustrated in FIG. 5A. In other words, hydraulic fluid (as illustrated by the wide-upward-diagonal hatching) can be added to the first section 230*a*, the second section 230*b*, and the third section 230*c* of the hydraulic line 212 such that the first pair of drives 228*a*, the second pair of drives 228*b*, and the third pair of drives 228*c* transition to the extended configuration. In some examples, in the transition from FIG. 5A to FIG. 5B, the first pair of drives 228*a* can transition from the extended configuration to the retracted configuration.

Figure 5B:
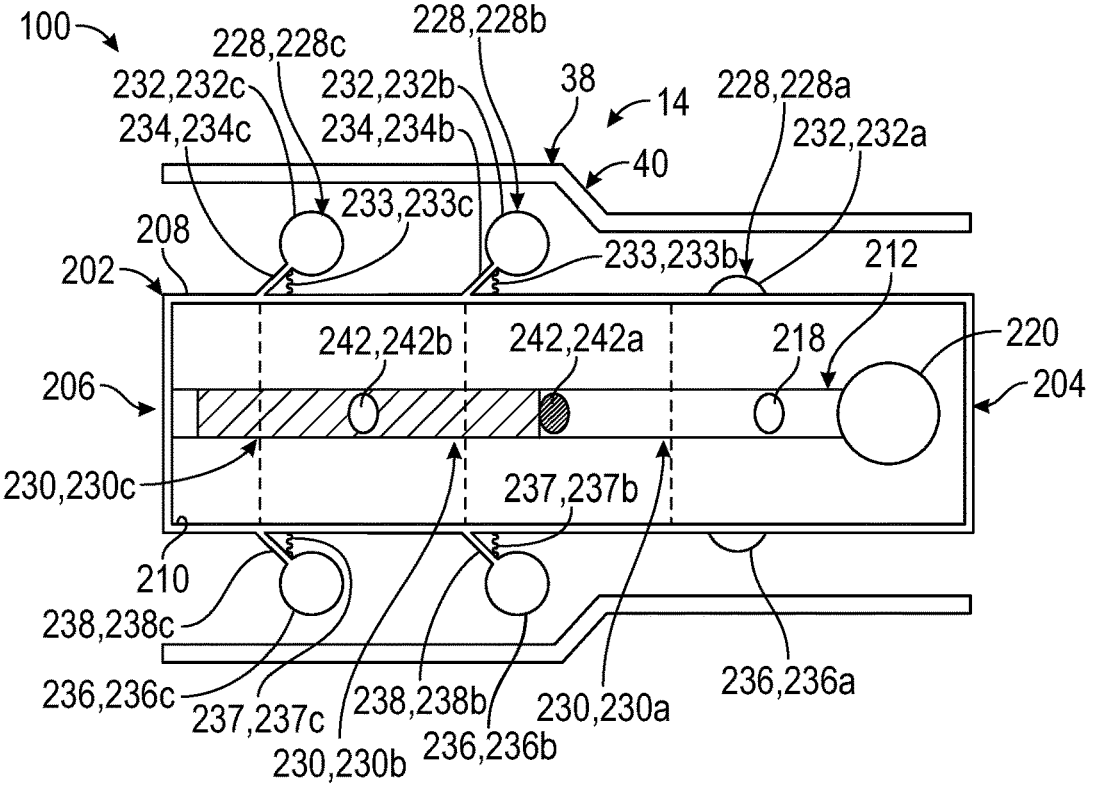

Continuing with method 421, at block 428, the first valve 242*a* can be closed (as illustrated by the upward-diagonal hatching), as illustrated in FIG. 5B. At block 430, the hydraulic control unit (not shown in FIGS. 5A-5G) can remove the hydraulic fluid from the hydraulic line 212 (e.g., valve 218 can be opened for hydraulic fluid to flow through the valve 218 (as illustrated by the white oval without hatching) out of the hydraulic line 212) such that the first pair of drives 228*a* transitions to a retracted configuration and the second pair of drives 228*b* and the third pair of drives 228*c* remain in the extended configuration, as illustrated in FIG. 5B. In other words, hydraulic fluid can be removed from the first section 230*a* of the hydraulic line 212 such that the first pair of drives 228*a* transitions to a retracted configuration. Hydraulic fluid can remain in the second section 230*b* and third section 230*c* of the hydraulic line 212 such that the second pair of drives 228*b* and the third pair of drives 228*c* remain in the extended configuration. In some examples, in the transition from FIG. 5B to FIG. 5C, the second pair of drives 228*b* can transition from the extended configuration to the retracted configuration.

Figure 5C:
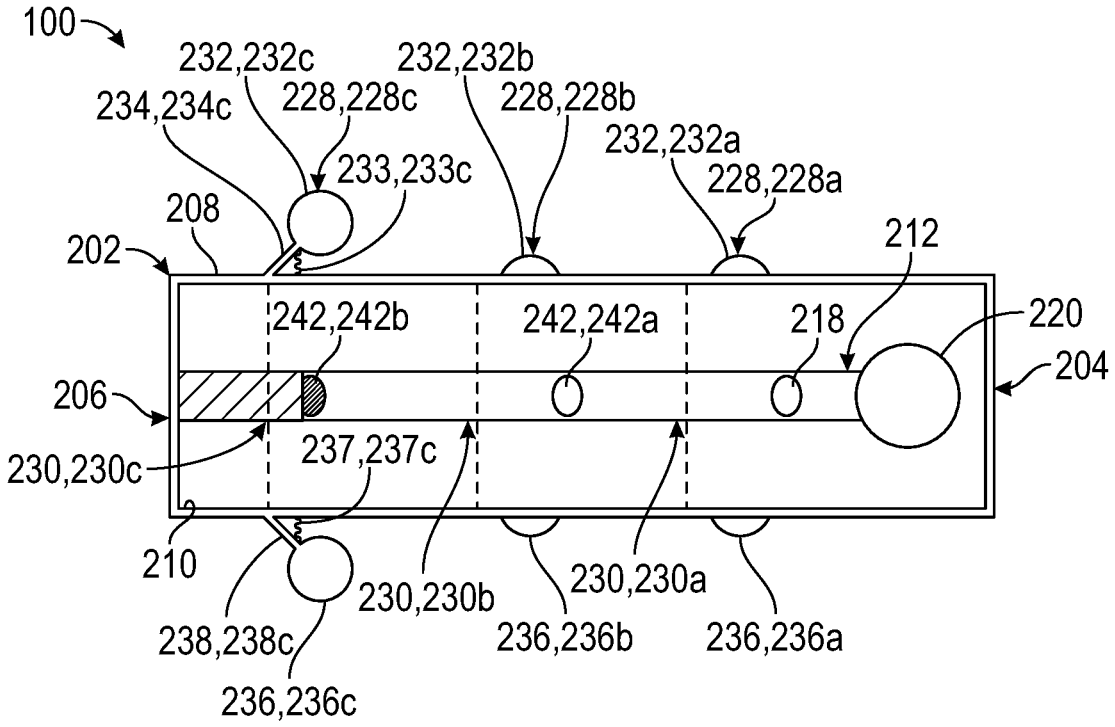

Method 431 discusses one example of transitioning the first pair of drives 228*a* to the extended configuration and transitioning the second pair of drives 228*b* to the retracted configuration. At block 432, the first valve 242*a* can be opened, as illustrated in FIG. 5C. At block 434, the second valve 242*b* can be closed. At block 436, the hydraulic control unit (not shown in FIGS. 5A-5G) can remove the hydraulic fluid from the hydraulic line 212 (e.g., valve 218 can be opened for hydraulic fluid to flow through the valve 218 out of the hydraulic line 212) such that the first pair of drives 228*a* and the second pair of drives 228*b* are in the retracted configuration and the third pair of drives 228*c* remains in the extended configuration, as illustrated in FIG. 5C. In other words, hydraulic fluid can be removed from the first section 230*a* and the second section 230*b* of the hydraulic line 212 such that the first pair of drives 228*a* and the second pair of drives 228*b* transition to a retracted configuration. Hydraulic fluid can remain in the third section 230*c* of the hydraulic line 212 such that the third pair of drives 228*c* remains in the extended configuration. In some examples, in the transition from FIG. 5C to FIG. 5D, the first pair of drives 228*a* can transition from the retracted configuration to the extended configuration.

Figure 5D:
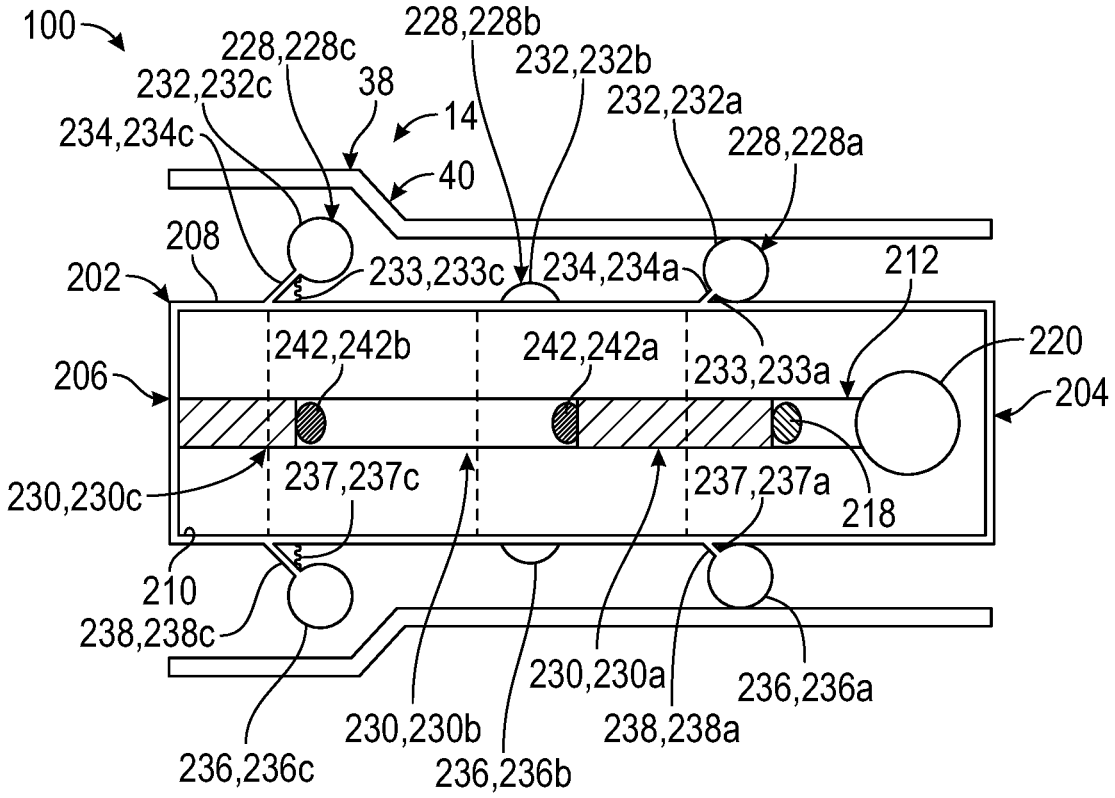

Continuing with method 431, at block 438, the first valve 242*a* can be closed, as illustrated in FIG. 5D. At block 440, the hydraulic control unit (not shown in FIGS. 5A-5G) can add the hydraulic fluid to the hydraulic line 212 (e.g., valve 218 can be opened for hydraulic fluid to flow through the valve 218 into the hydraulic line 212) such that the first pair of drives 228*a* transitions to the extended configuration, the second pair of drives 228*b* remains in the retracted configuration, and the third pair of drives 228*c* remains in the extended configuration, as illustrated in FIG. 5D. In other words, hydraulic fluid can be added to the first section 230*a* of the hydraulic line 212 such that the first pair of drives 228*a* transitions to the extended configuration. The second pair of drives 228*b* can remain in the retracted configuration. Hydraulic fluid can remain in the third section 230*c* of the hydraulic line 212 such that the third pair of drives 228*c* remains in the extended configuration. In some examples, in the transition from FIG. 5D to FIG. 5E, both the first pair of drives 228*a* and the third pair of drives 228*c* can transition from the extended configuration to the retracted configuration.

Figure 5E:
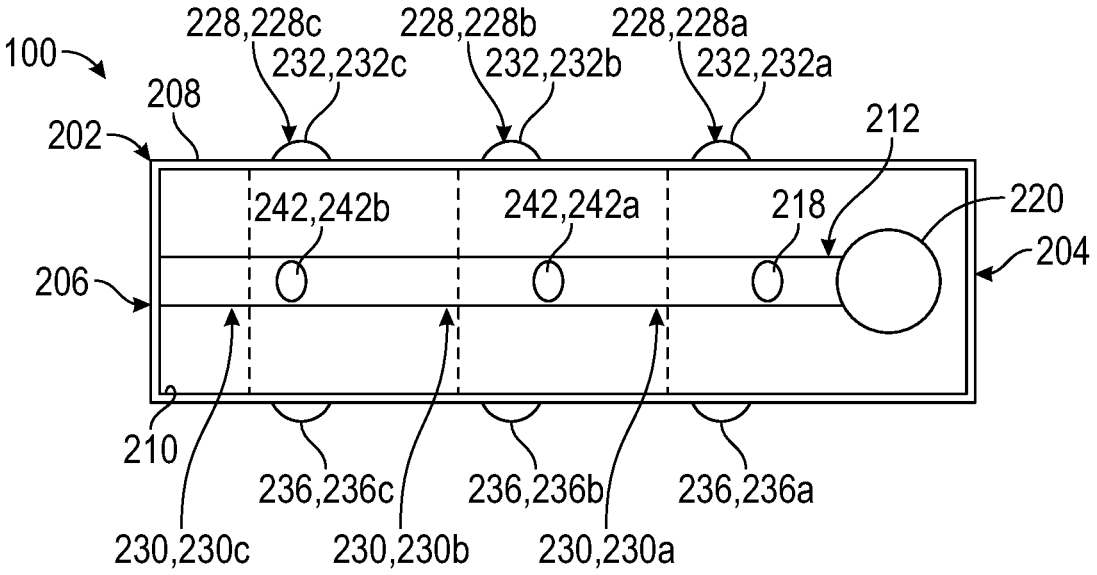

Method 441 discusses one example of transitioning the second pair of drives 228*b* to the extended configuration and transitioning the third pair of drives 228*c* to the retracted configuration. At block 442, the first valve 242*a* can be opened, as illustrated in FIG. 5E. At block 444, the second valve 242*b* can be opened. At block 446, the hydraulic control unit (not shown in FIGS. 5A-5G) can remove the hydraulic fluid from the hydraulic line 212 (e.g., valve 218 can be opened for hydraulic fluid to flow through the valve 218 out of the hydraulic line 212) such that the first pair of drives 228*a*, the second pair of drives 228*b*, and the third pair of drives 228*c* are in the retracted configuration, as illustrated in FIG. 5E. In other words, hydraulic fluid can be removed from the first section 230*a* and the third section 230*c* of the hydraulic line 212 such that the first pair of drives 228*a* and the third pair of drives 228*c* transition to the retracted configuration. The second pair of drives 228*b* can remain in the retracted configuration. In some examples, in the transition from FIG. 5E to FIG. 5F, both the first pair of drives 228*a* and the second pair of drives 228*b* can transition from the retracted configuration to the extended configuration.

Figure 5F:
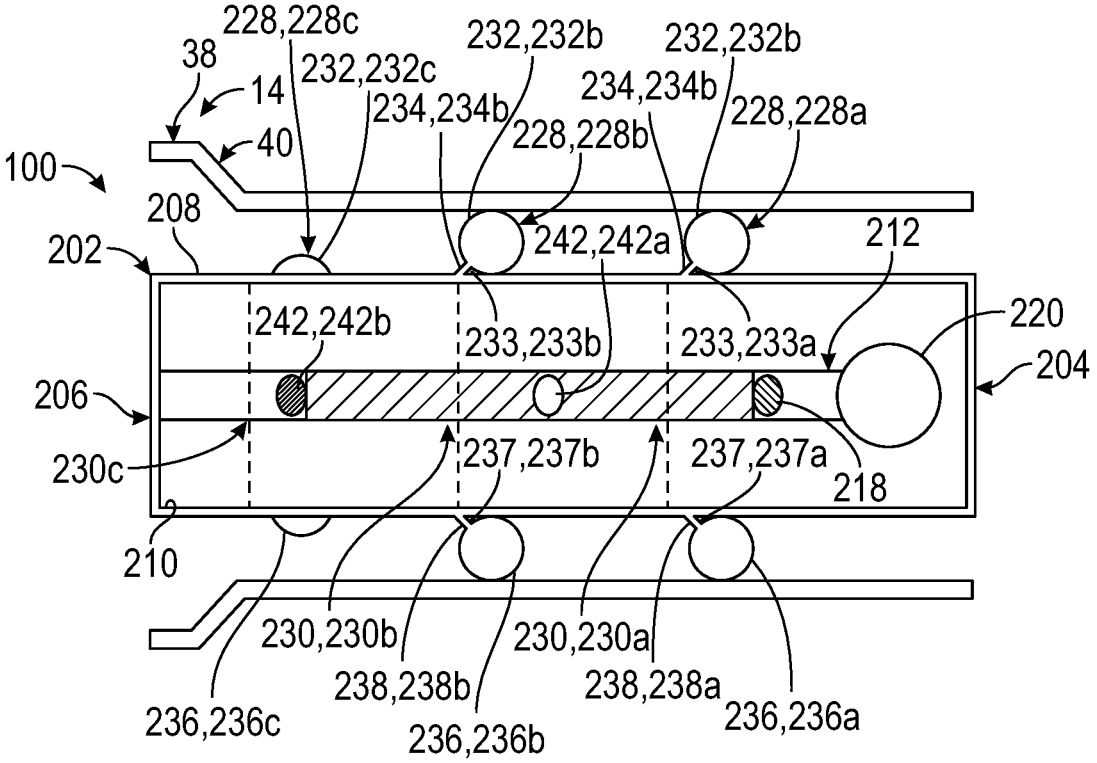
Figure 5G:
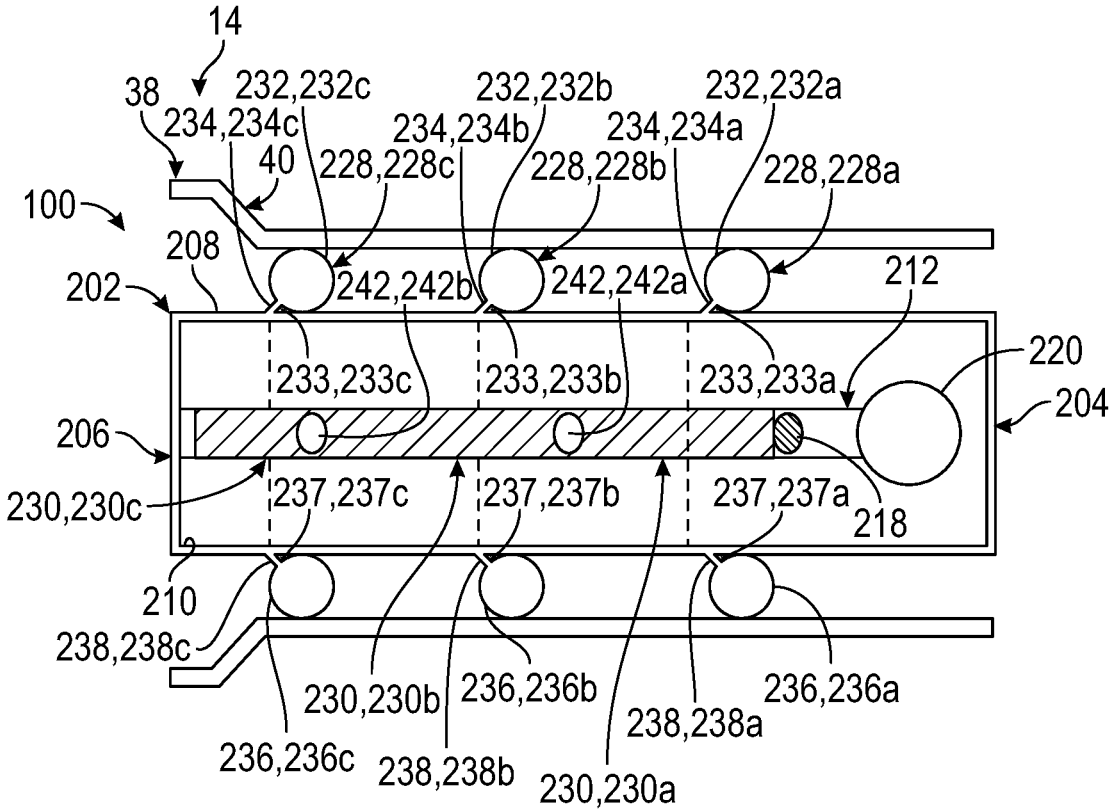

Continuing with method 431, at block 448, the second valve 242*b* can be closed, as illustrated in FIG. 5F. At block 450, the hydraulic control unit (not shown in FIGS. 5A-5G) can add the hydraulic fluid to the hydraulic line 212 (e.g., valve 218 can be opened for hydraulic fluid to flow through the valve 218 into the hydraulic line 212) such that the first pair of drives 228*a* and the second pair of drives 228*b* transition to the extended configuration and the third pair of drives 228*c* remains in the retracted configuration. In other words, hydraulic fluid can be added to the first section 230*a* and second section 230*b* of the hydraulic line 212 such that the first pair of drives 228*a* and the second pair of drives 228*b* transition to the extended configuration. The third pair of drives 228*c* can remain in the retracted configuration. In some examples, in the transition from FIG. 5F to FIG. 5G, the third pair of drives 228*c* can transition from the retracted configuration to the extended configuration.

In at least one example, the first valve 242*a* and the second valve 242*b* can both be opened, as illustrated in FIG.

5G. The hydraulic control unit (not shown in FIGS. 5A-5G) can add hydraulic fluid to the hydraulic line 212 (e.g., valve 218 can be opened for hydraulic fluid to flow through the valve 218 into the hydraulic line 212) such that the third pair of drives 228*c* transitions to the extended configuration. In other words, hydraulic fluid can be added to the third section 230*c* of the hydraulic line 212 such that the third pair of drives 228*c* transitions to the extended configuration. Hydraulic fluid can remain in the first section 230*a* and the second section 230*b* of the hydraulic line 212 such that the first pair of drives 228*a* and the second pair of drives 228*b* remain in the extended configuration.

While the above steps can be controlled and/or triggered by a controller 300 remote and/or at the surface, in some examples, the steps can be controlled and/or triggered automatically without user assistance and/or input. For example, when a drive 232, 236 and/or pair of drives 228 abut against the restriction 40 (e.g., narrowed section) of the wellbore 14, a spike in hydraulic pressure can be measured as the wellbore 14 pushes against the drive(s) 232, 236, 228. When the hydraulic pressure exceeds a certain threshold, the steps can be triggered automatically. In some examples and/or additionally, sensors such as radar, lidar, cameras, etc. can be included to sense the wellbore 14 and/or the positioning of the wellbore tractor 100.

Numerous examples are provided herein to enhance understanding of the present disclosure. A specific set of statements are provided as follows.

Statement 1: A wellbore tractor comprising: a body; a hydraulic line disposed in the body; a hydraulic control unit coupled to the hydraulic line, the hydraulic control unit operable to add hydraulic fluid to and/or remove the hydraulic fluid from the hydraulic line; a first pair of drives in fluid communication with a first section of the hydraulic line, each of the first pair of drives operable to move radially with respect to the body between a retracted configuration and an extended configuration; a second pair of drives in fluid communication with a second section of the hydraulic line, each of the second pair of drives operable to move radially with respect to the body between a retracted configuration and an extended configuration; a first valve disposed on the hydraulic line between the first pair of drives and the second pair of drives, the first valve operable to control flow of hydraulic fluid therethrough; a controller in communication with the hydraulic control unit and the first valve, wherein the controller is operable to transition only the first pair of drives to the retracted configuration by: opening the first valve; adding, by the hydraulic control unit, hydraulic fluid to the hydraulic line such that the first pair of drives and the second pair of drives are in the extended configuration; closing the first valve; and removing, by the hydraulic control unit, hydraulic fluid from the hydraulic line such that the first pair of drives transitions to the retracted configuration and the second pair of drives remains in the extended configuration.

Statement 2: The wellbore tractor of Statement 1, wherein the controller is operable to transition only the second pair of drives to the retracted configuration by: opening the first valve; removing, by the hydraulic control unit, hydraulic fluid from the hydraulic line such that the first pair of drives and the second pair of drives are in the retracted configuration; closing the first valve; and adding, by the hydraulic control unit, hydraulic fluid to the hydraulic line such that the first pair of drives transitions to the extended configuration and the second pair of drives remains in the retracted configuration.

Statement 3: The wellbore tractor of Statements 1 or 2, wherein the hydraulic line is only a single hydraulic line.

Statement 4: The wellbore tractor of any of preceding Statements 1-3, wherein the first pair of drives extend radially outward from the body to the extended configuration when hydraulic pressure in the first section is greater than a threshold value, wherein the first pair of drives retract inward towards the body to the retracted configuration when the hydraulic pressure in the first section is less than a lower threshold value, wherein the second pair of drives extend radially outward from the body to the extended configuration when hydraulic pressure in the second section is greater than a threshold value, wherein the second pair of drives retract inward towards the body to the retracted configuration when hydraulic pressure in the second section is less than a lower threshold value.

Statement 5: The wellbore tractor of any of preceding Statements 1-4, further comprising: at least one spring coupled with the first pair of drives and operable to transition the first pair of drives to the retracted configuration when hydraulic pressure in the first section is less than a lower threshold value; and at least one spring coupled with the second pair of drives and operable to transition the second pair of drives to the retracted configuration when hydraulic pressure in the second section is less than a lower threshold value.

Statement 6: The wellbore tractor of any of preceding Statements 1-5, wherein the first valve includes an electrically actuated solenoid valve, wherein the hydraulic control unit includes an electrically actuated solenoid valve and a pump.

Statement 7: The wellbore tractor of any of preceding Statements 1-6, further comprising: a third pair of drives in fluid communication with a third section of the hydraulic line, each of the third pair of drives operable to move radially with respect to the body between a retracted configuration and an extended configuration; and a second valve disposed on the hydraulic line between the second pair of drives and the third pair of drives, the second valve operable to control the flow of hydraulic fluid therethrough, wherein the controller is in communication with the second valve.

Statement 8: The wellbore tractor of Statement 7, wherein the controller is operable to transition only the third pair of drives to the retracted configuration by: opening the first valve and the second valve; removing, by the hydraulic control unit, the hydraulic fluid from the hydraulic line such that the first pair of drives, the second pair of drives, and the third pair of drives are in the retracted configuration; closing the second valve; adding, by the hydraulic control unit, the hydraulic fluid to the hydraulic line such that the first pair of drives and the second pair of drives transition to the extended configuration and the third pair of drives remains in the retracted configuration.

Statement 9: A non-transitory computer-readable storage medium comprising: instructions stored on the non-transitory computer-readable storage medium, the instructions, when executed by one or more processors, cause the one or more processors to: open a first valve disposed on a hydraulic line between a first pair of drives and a second pair of drives of a wellbore tractor, the first pair of drives in fluid communication with a first section of the hydraulic line, the second pair of drives in fluid communication with a second section of the hydraulic line; add, by a hydraulic control unit, hydraulic fluid to the hydraulic line such that the first pair of drives and the second pair of drives are in an extended configuration; close the first valve; and remove, by the hydraulic control unit, the hydraulic fluid from the hydraulic line such that the first pair of drives transitions to a retracted configuration and the second pair of drives remains in the extended configuration.

Statement 10: The non-transitory computer-readable storage medium of Statement 9, wherein the instructions, when executed by the one or more processors, further cause the one or more processors to: open the first valve; remove, by the hydraulic control unit, the hydraulic fluid from the hydraulic line such that the first pair of drives and the second pair of drives are in the retracted configuration; close the first valve; and add, by the hydraulic control unit, the hydraulic fluid to the hydraulic line such that the first pair of drives transitions to the extended configuration and the second pair of drives remains in the retracted configuration.

Statement 11: The non-transitory computer-readable storage medium of Statement 10, wherein the instructions, when executed by the one or more processors, further cause the one or more processors to: open the first valve; add, by the hydraulic control unit, the hydraulic fluid to the hydraulic line such that the first pair of drives and the second pair of drives transition to the extended configuration.

Statement 12: The non-transitory computer-readable storage medium of any of preceding Statements 9-11, wherein the instructions, when executed by the one or more processors, further cause the one or more processors to: open the first valve; open a second valve disposed on the hydraulic line between the second pair of drives and a third pair of drives, the third pair of drives in fluid communication with a third section of the hydraulic line; add, by the hydraulic control unit, the hydraulic fluid to the hydraulic line such that the first pair of drives, the second pair of drives, and the third pair of drives transition to the extended configuration; and close the first valve; remove, by the hydraulic control unit, the hydraulic fluid from the hydraulic line such that the first pair of drives transitions to a retracted configuration and the second pair of drives and the third pair of drives remain in the extended configuration.

Statement 13: The non-transitory computer-readable storage medium of Statement 12, wherein the instructions, when executed by the one or more processors, further cause the one or more processors to: open the first valve; close the second valve; remove, by the hydraulic control unit, the hydraulic fluid from the hydraulic line such that the first pair of drives and the second pair of drives are in the retracted configuration and the third pair of drives remains in the extended configuration; close the first valve; and add, by the hydraulic control unit, the hydraulic fluid to the hydraulic line such that the first pair of drives transitions to the extended configuration, the second pair of drives remains in the retracted configuration, and the third pair of drives remains in the extended configuration.

Statement 14: The non-transitory computer-readable storage medium of Statements 12 or 13, wherein the instructions, when executed by the one or more processors, further cause the one or more processors to: open the first valve; open the second valve; remove, by the hydraulic control unit, the hydraulic fluid from the hydraulic line such that the first pair of drives, the second pair of drives, and the third pair of drives are in the retracted configuration; close the second valve; and add, by the hydraulic control unit, the hydraulic fluid to the hydraulic line such that the first pair of drives and the second pair of drives transition to the extended configuration and the third pair of drives remains in the retracted configuration.

Statement 15: A method for moving a wellbore tractor through a wellbore, the method comprising: opening a first valve disposed on a hydraulic line between a first pair of drives and a second pair of drives of a wellbore tractor, the first pair of drives in fluid communication with a first section of the hydraulic line, the second pair of drives in fluid communication with a second section of the hydraulic line; adding, by a hydraulic control unit, hydraulic fluid to the hydraulic line such that the first pair of drives and the second pair of drives are in an extended configuration; closing the first valve; and removing, by the hydraulic control unit, the hydraulic fluid from the hydraulic line such that the first pair of drives transitions to a retracted configuration and the second pair of drives remains in the extended configuration.

Statement 16: The method of Statement 15 further comprising: opening the first valve; removing, by the hydraulic control unit, the hydraulic fluid from the hydraulic line such that the first pair of drives and the second pair of drives are in the retracted configuration; closing the first valve; adding, by the hydraulic control unit, the hydraulic fluid to the hydraulic line such that the first pair of drives transitions to the extended configuration and the second pair of drives remains in the retracted configuration.

Statement 17: The method of Statement 16 further comprising: opening the first valve; adding, by the hydraulic control unit, the hydraulic fluid to the hydraulic line such that the first pair of drives and the second pair of drives transition to the extended configuration.

Statement 18: The method of any of preceding Statements 15-17 further comprising: opening the first valve; opening a second valve disposed on the hydraulic line between the second pair of drives and a third pair of drives, the third pair of drives in fluid communication with a third section of the hydraulic line; adding, by the hydraulic control unit, the hydraulic fluid to the hydraulic line such that the first pair of drives, the second pair of drives, and the third pair of drives transition to the extended configuration; closing the first valve; and removing, by the hydraulic control unit, the hydraulic fluid from the hydraulic line such that the first pair of drives transitions to a retracted configuration and the second pair of drives and the third pair of drives remain in the extended configuration.

Statement 19: The method of Statement 18 further comprising: opening the first valve; closing the second valve; removing, by the hydraulic control unit, the hydraulic fluid from the hydraulic line such that the first pair of drives and the second pair of drives are in the retracted configuration and the third pair of drives remains in the extended configuration; closing the first valve; and adding, by the hydraulic control unit, the hydraulic fluid to the hydraulic line such that the first pair of drives transitions to the extended configuration, the second pair of drives remains in the retracted configuration, and the third pair of drives remains in the extended configuration.

Statement 20: The method of Statements 18 or 19 further comprising: opening the first valve; opening the second valve; removing, by the hydraulic control unit, the hydraulic fluid from the hydraulic line such that the first pair of drives, the second pair of drives, and the third pair of drives are in the retracted configuration; closing the second valve; and adding, by the hydraulic control unit, the hydraulic fluid to the hydraulic line such that the first pair of drives and the second pair of drives transition to the extended configuration and the third pair of drives remains in the retracted configuration.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A wellbore tractor comprising:

a body;

a hydraulic line disposed in the body;

a hydraulic control unit coupled to the hydraulic line, the hydraulic control unit operable to add hydraulic fluid to and/or remove the hydraulic fluid from the hydraulic line;

a first pair of drives in fluid communication with a first section of the hydraulic line, each of the first pair of drives operable to move radially with respect to the body between a retracted configuration and an extended configuration;

a second pair of drives in fluid communication with a second section of the hydraulic line, each of the second pair of drives operable to move radially with respect to the body between a retracted configuration and an extended configuration;

a third pair of drives in fluid communication with a third section of the hydraulic line, each of the third pair of drives operable to move radially with respect to the body between a retracted configuration and an extended configuration;

a first valve disposed on the hydraulic line between the first pair of drives and the second pair of drives, the first valve operable to control flow of hydraulic fluid therethrough;

a second valve disposed on the hydraulic line between the second pair of drives and the third pair of drives, the second valve operable to control the flow of hydraulic fluid therethrough, a controller in communication with the hydraulic control unit, the first valve, and the second valve, wherein the controller is operable to transition only the first pair of drives to the retracted configuration by:

opening the first valve;

adding, by the hydraulic control unit, hydraulic fluid to the hydraulic line such that the first pair of drives and the second pair of drives are in the extended configuration;

closing the first valve; and removing, by the hydraulic control unit, hydraulic fluid from the hydraulic line such that the first pair of drives transitions to the retracted configuration and the second pair of drives remains in the extended configuration.

2. The wellbore tractor of claim 1, wherein the controller is operable to transition only the second pair of drives to the retracted configuration by:

opening the first valve;

removing, by the hydraulic control unit, hydraulic fluid from the hydraulic line such that the first pair of drives and the second pair of drives are in the retracted configuration;

closing the first valve; and adding, by the hydraulic control unit, hydraulic fluid to the hydraulic line such that the first pair of drives transitions to the extended configuration and the second pair of drives remains in the retracted configuration.

3. The wellbore tractor of claim 1, wherein the hydraulic line is only a single hydraulic line.

4. The wellbore tractor of claim 1, wherein the first pair of drives extend radially outward from the body to the extended configuration when hydraulic pressure in the first section is greater than a threshold value, wherein the first pair of drives retract inward towards the body to the retracted configuration when the hydraulic pressure in the first section is less than a lower threshold value, wherein the second pair of drives extend radially outward from the body to the extended configuration when hydraulic pressure in the second section is greater than the threshold value, wherein the second pair of drives retract inward towards the body to the retracted configuration when hydraulic pressure in the second section is less than the lower threshold value.

5. The wellbore tractor of claim 1, further comprising:

at least one spring coupled with the first pair of drives and operable to transition the first pair of drives to the retracted configuration when hydraulic pressure in the first section is less than a lower threshold value; and at least one spring coupled with the second pair of drives and operable to transition the second pair of drives to the retracted configuration when hydraulic pressure in the second section is less than the lower threshold value.

6. The wellbore tractor of claim 1, wherein the first valve includes an electrically actuated solenoid valve, wherein the hydraulic control unit includes an electrically actuated solenoid valve and a pump.

7. The wellbore tractor of claim 1, wherein the controller is operable to transition only the third pair of drives to the retracted configuration by:

opening the first valve and the second valve;

removing, by the hydraulic control unit, the hydraulic fluid from the hydraulic line such that the first pair of drives, the second pair of drives, and the third pair of drives are in the retracted configuration;

closing the second valve;

adding, by the hydraulic control unit, the hydraulic fluid to the hydraulic line such that the first pair of drives and the second pair of drives transition to the extended configuration and the third pair of drives remains in the retracted configuration.

8. A non-transitory computer-readable storage medium comprising:

instructions stored on the non-transitory computer-readable storage medium, the instructions, when executed by one or more processors, cause the one or more processors to:

open a first valve disposed on a hydraulic line between a first pair of drives and a second pair of drives of a wellbore tractor, the first pair of drives in fluid communication with a first section of the hydraulic line, the second pair of drives in fluid communication with a second section of the hydraulic line;

add, by a hydraulic control unit, hydraulic fluid to the hydraulic line such that the first pair of drives and the second pair of drives are in an extended configuration;

close the first valve;

remove, by the hydraulic control unit, the hydraulic fluid from the hydraulic line such that the first pair of drives transitions to a retracted configuration and the second pair of drives remains in the extended configuration;

open the first valve;

open a second valve disposed on the hydraulic line between the second pair of drives and a third pair of drives, the third pair of drives in fluid communication with a third section of the hydraulic line;

add, by the hydraulic control unit, the hydraulic fluid to the hydraulic line such that the first pair of drives, the second pair of drives, and the third pair of drives transition to the extended configuration;

close the first valve; and remove, by the hydraulic control unit, the hydraulic fluid from the hydraulic line such that the first pair of drives transitions to a retracted configuration and the second pair of drives and the third pair of drives remain in the extended configuration.

9. The non-transitory computer-readable storage medium of claim 8, wherein the instructions, when executed by the one or more processors, further cause the one or more processors to:

open the first valve;

remove, by the hydraulic control unit, the hydraulic fluid from the hydraulic line such that the first pair of drives and the second pair of drives are in the retracted configuration;

close the first valve; and add, by the hydraulic control unit, the hydraulic fluid to the hydraulic line such that the first pair of drives transitions to the extended configuration and the second pair of drives remains in the retracted configuration.

10. The non-transitory computer-readable storage medium of claim 9, wherein the instructions, when executed by the one or more processors, further cause the one or more processors to:

open the first valve;

add, by the hydraulic control unit, the hydraulic fluid to the hydraulic line such that the first pair of drives and the second pair of drives transition to the extended configuration.

11. The non-transitory computer-readable storage medium of claim 8, wherein the instructions, when executed by the one or more processors, further cause the one or more processors to:

open the first valve;

close the second valve;

remove, by the hydraulic control unit, the hydraulic fluid from the hydraulic line such that the first pair of drives and the second pair of drives are in the retracted configuration and the third pair of drives remains in the extended configuration;

close the first valve; and add, by the hydraulic control unit, the hydraulic fluid to the hydraulic line such that the first pair of drives transitions to the extended configuration, the second pair of drives remains in the retracted configuration, and the third pair of drives remains in the extended configuration.

12. The non-transitory computer-readable storage medium of claim 8, wherein the instructions, when executed by the one or more processors, further cause the one or more processors to:

open the first valve;

open the second valve;

remove, by the hydraulic control unit, the hydraulic fluid from the hydraulic line such that the first pair of drives, the second pair of drives, and the third pair of drives are in the retracted configuration;

close the second valve; and add, by the hydraulic control unit, the hydraulic fluid to the hydraulic line such that the first pair of drives and the second pair of drives transition to the extended configuration and the third pair of drives remains in the retracted configuration.

13. A method for moving a wellbore tractor through a wellbore, the method comprising:

opening a first valve disposed on a hydraulic line between a first pair of drives and a second pair of drives of the wellbore tractor, the first pair of drives in fluid communication with a first section of the hydraulic line, the second pair of drives in fluid communication with a second section of the hydraulic line;

adding, by a hydraulic control unit, hydraulic fluid to the hydraulic line such that the first pair of drives and the second pair of drives are in an extended configuration;

closing the first valve;

removing, by the hydraulic control unit, the hydraulic fluid from the hydraulic line such that the first pair of drives transitions to a retracted configuration and the second pair of drives remains in the extended configuration;

opening the first valve;

opening a second valve disposed on the hydraulic line between the second pair of drives and a third pair of drives, the third pair of drives in fluid communication with a third section of the hydraulic line;

adding, by the hydraulic control unit, the hydraulic fluid to the hydraulic line such that the first pair of drives, the second pair of drives, and the third pair of drives transition to the extended configuration;

closing the first valve; and removing, by the hydraulic control unit, the hydraulic fluid from the hydraulic line such that the first pair of drives transitions to a retracted configuration and the second pair of drives and the third pair of drives remain in the extended configuration.

14. The method of claim 13 further comprising:

opening the first valve;

removing, by the hydraulic control unit, the hydraulic fluid from the hydraulic line such that the first pair of drives and the second pair of drives are in the retracted configuration;

closing the first valve;

adding, by the hydraulic control unit, the hydraulic fluid to the hydraulic line such that the first pair of drives transitions to the extended configuration and the second pair of drives remains in the retracted configuration.

15. The method of claim 14 further comprising:

opening the first valve;

adding, by the hydraulic control unit, the hydraulic fluid to the hydraulic line such that the first pair of drives and the second pair of drives transition to the extended configuration.

16. The method of claim 13 further comprising:

opening the first valve;

closing the second valve;

removing, by the hydraulic control unit, the hydraulic fluid from the hydraulic line such that the first pair of drives and the second pair of drives are in the retracted configuration and the third pair of drives remains in the extended configuration;

closing the first valve; and adding, by the hydraulic control unit, the hydraulic fluid to the hydraulic line such that the first pair of drives transitions to the extended configuration, the second pair of drives remains in the retracted configuration, and the third pair of drives remains in the extended configuration.

17. The method of claim 13, further comprising:

opening the first valve;

opening the second valve;

removing, by the hydraulic control unit, the hydraulic fluid from the hydraulic line such that the first pair of drives, the second pair of drives, and the third pair of drives are in the retracted configuration;

closing the second valve; and adding, by the hydraulic control unit, the hydraulic fluid to the hydraulic line such that the first pair of drives and the second pair of drives transition to the extended configuration and the third pair of drives remains in the retracted configuration.

* * * * *